US007943280B2

(12) United States Patent
Uchinokura et al.

(10) Patent No.: US 7,943,280 B2
(45) Date of Patent: May 17, 2011

(54) TONER CONTAINING A LAMINAR INORGANIC MINERAL IN WHICH PART OR ALL OF THE IONS PRESENT BETWEEN LAYERS ARE MODIFIED BY ORGANIC IONS

(75) Inventors: Osamu Uchinokura, Mishima (JP); Naohiro Watanabe, Shizuoka-ken (JP); Junichi Awamura, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 764 days.

(21) Appl. No.: 11/685,872

(22) Filed: Mar. 14, 2007

(65) Prior Publication Data

US 2007/0218380 A1 Sep. 20, 2007

(30) Foreign Application Priority Data

Mar. 15, 2006 (JP) ..... 2006-070639

(51) Int. Cl.
*G03G 9/08* (2006.01)

(52) U.S. Cl. ..... 430/108.2; 430/108.1; 430/108.3; 430/137.18; 430/109.3; 430/109.4

(58) Field of Classification Search ..... 430/108.1, 430/108.3, 109.3, 109.4, 137.18, 108.2
See application file for complete search history.

(56) References Cited

U.S. PATENT DOCUMENTS

| | | | | |
|---|---|---|---|---|
| 6,360,068 | B1 | 3/2002 | Kinoshita et al. | |
| 6,416,914 | B1 | 7/2002 | Nakamura et al. | |
| 6,432,589 | B1 | 8/2002 | Uchinokura et al. | |
| 6,432,590 | B1 | 8/2002 | Ueda et al. | |
| 6,479,204 | B1 | 11/2002 | Uchinokura et al. | |
| 6,503,676 | B2 | 1/2003 | Yamashita et al. | |
| 6,641,969 | B2 | 11/2003 | Uchinokura et al. | |
| 6,733,939 | B2 | 5/2004 | Nanya et al. | |
| 6,737,210 | B2 | 5/2004 | Uchinokura et al. | |
| 6,756,175 | B2 | 6/2004 | Emoto et al. | |
| 6,787,280 | B2 | 9/2004 | Yamashita et al. | |
| 6,818,370 | B2 | 11/2004 | Uchinokura et al. | |
| 6,846,604 | B2 | 1/2005 | Emoto et al. | |
| 6,849,369 | B2 | 2/2005 | Yagi et al. | |
| 6,852,462 | B2 | 2/2005 | Emoto et al. | |
| 6,855,468 | B1 | 2/2005 | Yamamoto et al. | |
| 6,916,587 | B2 | 7/2005 | Fushimi et al. | |
| 6,936,390 | B2 | 8/2005 | Nanya et al. | |
| 7,056,635 | B2 | 6/2006 | Tanaka et al. | |
| 7,056,638 | B1 | 6/2006 | Tomita et al. | |
| 7,083,890 | B2 | 8/2006 | Emoto et al. | |
| 7,129,013 | B2 | 10/2006 | Higuchi et al. | |
| 7,163,775 | B2 | 1/2007 | Takada et al. | |
| 7,309,558 | B1 * | 12/2007 | Michel et al. | 430/137.1 |
| 2004/0058266 | A1 * | 3/2004 | Matsumura et al. | 430/109.2 |
| 2004/0131961 | A1 | 7/2004 | Watanabe et al. | |
| 2004/0157146 | A1 | 8/2004 | Tomita et al. | |
| 2004/0175641 | A1 | 9/2004 | Nanya et al. | |
| 2004/0229147 | A1 | 11/2004 | Higuchi et al. | |
| 2004/0265721 | A1 | 12/2004 | Matsuoka et al. | |
| 2005/0003289 | A1 | 1/2005 | Fushimi et al. | |
| 2005/0026066 | A1 | 2/2005 | Tanaka et al. | |
| 2005/0031980 | A1 | 2/2005 | Inoue et al. | |
| 2005/0042534 | A1 | 2/2005 | Tanaka et al. | |
| 2005/0089786 | A1 | 4/2005 | Sugiura et al. | |
| 2005/0089787 | A1 | 4/2005 | Uchinokura et al. | |
| 2005/0112488 | A1 | 5/2005 | Yamada et al. | |
| 2005/0164112 | A1 | 7/2005 | Ohki et al. | |
| 2005/0164114 | A1 | 7/2005 | Yagi et al. | |
| 2005/0180786 | A1 | 8/2005 | Yamada et al. | |
| 2005/0186498 | A1 | 8/2005 | Honda et al. | |
| 2005/0208408 | A1 | 9/2005 | Uchinokura et al. | |
| 2005/0208411 | A1 | 9/2005 | Nakayama et al. | |
| 2005/0255400 | A1 * | 11/2005 | Jung et al. | 430/110.2 |
| 2005/0277040 | A1 * | 12/2005 | Michel et al. | 430/108.2 |
| 2005/0277044 | A1 | 12/2005 | Watanabe et al. | |
| 2005/0277045 | A1 | 12/2005 | Saito et al. | |
| 2006/0024097 | A1 | 2/2006 | Yamada et al. | |
| 2006/0029433 | A1 | 2/2006 | Saito et al. | |
| 2006/0046174 | A1 | 3/2006 | Ohki et al. | |
| 2006/0057488 | A1 | 3/2006 | Inoue et al. | |
| 2006/0063081 | A1 | 3/2006 | Nagatomo et al. | |
| 2006/0063089 | A1 | 3/2006 | Tanaka et al. | |
| 2006/0068312 | A1 | 3/2006 | Yamashita et al. | |
| 2006/0068313 | A1 | 3/2006 | Nakayama et al. | |
| 2006/0099529 | A1 | 5/2006 | Tanaka et al. | |

(Continued)

FOREIGN PATENT DOCUMENTS

| | | |
|---|---|---|
| JP | 2003-202708 | 7/2003 |

(Continued)

OTHER PUBLICATIONS

BENTONE 38 Product Data Sheet, Elementis Specialties (Jan. 2009).*

(Continued)

*Primary Examiner* — Christopher RoDee
(74) *Attorney, Agent, or Firm* — Oblon, Spivak, McClelland, Maier & Neustadt, L.L.P.

(57) ABSTRACT

A toner containing a colorant, a binder resin and a laminar inorganic mineral in which part or all of the ions present between layers are modified by organic ions. The toner can be prepared by a method including dispersing or emulsifying a toner constituent mixture liquid containing the colorant, the binder resin and/or a precursor thereof, and the laminar inorganic mineral, in an aqueous medium. The density of the laminar inorganic mineral measured by XPS for the toner surface before (A) and after (B) mixing and kneading satisfies the following relationship: A>B.

19 Claims, 4 Drawing Sheets

U.S. PATENT DOCUMENTS

| | | | | |
|---|---|---|---|---|
| 2006/0160011 | A1 | 7/2006 | Inoue et al. | |
| 2006/0204883 | A1 | 9/2006 | Nakayama et al. | |
| 2006/0210903 | A1 | 9/2006 | Ohki et al. | |
| 2006/0251979 | A1 | 11/2006 | Watanabe et al. | |
| 2007/0003855 | A1 * | 1/2007 | Veregin et al. | 430/108.3 |
| 2008/0107986 | A1 * | 5/2008 | Michel et al. | 430/84 |

FOREIGN PATENT DOCUMENTS

| | | | |
|---|---|---|---|
| WO | WO 01/40878 | A1 | 6/2001 |
| WO | WO 0140878 | A1 * | 6/2001 |
| WO | WO 2004/019137 | A1 | 3/2004 |
| WO | WO 2005111729 | A2 * | 11/2005 |

OTHER PUBLICATIONS

BENTONE 38V Product Data Sheet, Elementis Specialties (no date).*

CLAYTONE AF Product Data Sheet, Southern Clay Products (Jan. 2009).*

CLAYTONE APA Material Safety Data Sheet, Southern Clay Products (Oct. 2008).*

CLAYTONE HY Material Safety Data Sheet, Southern Clay Products (Jan. 2009).*

Additive Reference Guide, Souther Clay Products (no date).*

"Montmorillonite" data sheet, ver. 1.2, Mineralogical Society of America, Chantilly, Virginia (2001).*

"Hydrotalcite" data sheet, ver. 1, Mineralogical Society of America, Chantilly, Virginia (2005).*

DHT-4A Product Information, Kisuma Chemicals, retrieved from <http://www.kisuma.com/dht-4a-dht-4v-zht-4a-2.html> on Jan. 19, 2010.*

No. 655 Labo Plastomill, Toyo Seiki website. <<http://www.toyoseiki.co.jp/toyo_e/c/ec_655.html>> retrieved Jun. 3, 2010.*

U.S. Appl. No. 11/685,969, filed Mar. 14, 2007, Uchinokura, et al.

U.S. Appl. No. 12/203,278, filed Sep. 3, 2008, Yamada, et al.

U.S. Appl. No. 12/040,451, filed Feb. 29, 2008, Saitoh, et al.

U.S. Appl. No. 12/046,941, filed Mar. 12, 2008, Awamura, et al.

* cited by examiner

TONER CONTAINING A LAMINAR INORGANIC MINERAL IN WHICH PART OR ALL OF THE IONS PRESENT BETWEEN LAYERS ARE MODIFIED BY ORGANIC IONS

BACKGROUND OF THE INVENTION

1. Field of the Invention

The present invention relates to a toner. In a preferred embodiment a toner is described comprising a colorant, a binder resin and a laminar inorganic mineral in which part or all of the ions present between layers are modified by organic ions. The toner can be prepared by a method including dispersing or emulsifying a toner constituent mixture liquid comprising the colorant, the binder resin and/or a precursor thereof, and the laminar inorganic mineral, in an aqueous medium. The density of the laminar inorganic mineral measured by XPS for the toner surface before (A) and after (B) mixing and kneading satisfies the following relationship: A>B.

2. Discussion of the Background

Various kinds of charge control agents are added to control the charging amount of toners. The toner manufactured by a pulverization method, in which a colorant and optional additives are added to a thermoplastic resin functioning as a binder resin and the mixture is pulverized and classified, has the following characteristics: (1) a limitation on size reduction of a toner, meaning that the quality of images is difficult to improve; (2) easy to uniformly disperse the material in each particle but difficult to control the position of the materials therein; and (3) an adverse impact on anti-filming property and fixing property when the amount of a charging controlling agent is increased to improve the charging property of a toner.

Recently, as in published unexamined Japanese patent applications Nos. 2003-515795, 2006-500605, 2006-53313 and 2003-202708, modified laminar inorganic minerals, in which ions existing between the layers are partly modified by organic ions, have been used as a charge controlling agent. These still involve with the characteristics mentioned above.

SUMMARY OF THE INVENTION

Because of these reasons, a need exists for a toner having the following characteristics: (1) an excellent charging property with a small amount of a charge controlling agent; (2) restraining the occurrence of filming with an excellent low temperature fixing property and stable charging property; and (3) producing quality images with excellent fine dot representation.

Accordingly, an object of the present invention is to provide a toner having the following characteristics: (1) an excellent charging property by adding a small amount of a charge controlling agent; (2) restraining the occurrence of filming with an excellent low temperature fixing property and stable charging property; and (3) producing quality images with excellent fine dot representation (and an image forming apparatus satisfying (1) to (3)).

Briefly this object and other objects of the present invention as hereinafter described will become more readily apparent and are attained, either individually or in combination thereof, by a a toner containing a colorant, a binder resin and a laminar inorganic mineral in which part or all of the ions present between layers are modified by one or more organic ions and the toner is prepared by a method including dispersing or emulsifying a toner constituent mixture liquid containing the colorant, the binder resin and/or a precursor thereof, and the laminar inorganic mineral, in an aqueous medium The density A of the laminar inorganic mineral measured by XPS for the toner surface and the density B thereof by XPS of a toner surface for the toner after mixing and kneading satisfies the following relationship: A>B.

It is preferred that, in the toner mentioned above, the following relationship is satisfied: A>B×1.4.

It is still further preferred that, in the toner mentioned above, the density A and the density B can be measured using Al and the following relationship is satisfied: A>0.5 atomic %.

It is still further preferred that, in the toner mentioned above, part or all of the cations present between the layers is modified by one or more organic cations.

It is still further preferred that, in the toner mentioned above, the toner constituent mixture liquid comprises an organic solvent in which the colorant, the at least one member selected from the group consisting of the binder resin and a precursor of the binder resin, and the laminar inorganic mineral are dispersed or dissolved.

It is still further preferred that, in the toner mentioned above, the laminar inorganic mineral is from 0.05 to 5.0% by weight.

It is still further preferred that, in the toner mentioned above, the laminar inorganic mineral is from 0.05 to 2.0% by weight.

It is still further preferred that, in the toner mentioned above, the binder resin contains multiple kinds of binder resins.

It is still further preferred that, in the toner mentioned above, one of the multiple kinds of binder resins is a resin having a polyester skeleton.

It is still further preferred that, in the toner mentioned above, one of the multiple kinds of binder resins is a polyester resin.

It is still further preferred that, in the toner mentioned above, the polyester resin is a non-modified polyester resin.

It is still further preferred that, in the toner mentioned above, the precursor of the binder resin is a modified polyester resin.

It is still further preferred that the toner mentioned above is prepared by a method including; dissolving or dispersing the colorant, the binder resin, the precursor of the binder resin, a compound for conducting an elongation reaction or a crosslinking reaction with the precursor, the laminar inorganic mineral and a release agent in an organic solvent, to prepare a toner constituent mixture liquid; dispersing or emulsifying the toner constituent mixture liquid in an aqueous medium while subjecting the precursor to the crosslinking reaction or the elongation reaction with the compound, to prepare a toner dispersion; and removing the organic solvent from the toner dispersion.

It is still further preferred that, in the toner mentioned above, the ratio (Dv/Dn) of the volume average particle diameter (DV) of the toner to the number average particle diameter (Dn) of the toner is from 1.00 to 1.30 and particles of the toner having a circularity not greater than 0.950 occupies 20 to 80% of all the toner particles.

It is still further preferred that, in the toner mentioned above, the ratio of particles of the toner having a particle diameter not greater than 2 μm is from 1 to 20% by number.

It is still further preferred that, in the toner mentioned above, the content of the polyester resin in the binder resin ranges from 50 to 100% by weight.

It is still further preferred that, in the toner mentioned above, the weight average molecular weight of tetrahydrofuran soluble portion of the polyester resin ranges from 1,000 to 30,000.

It is still further preferred that, in the toner mentioned above, the resin having a polyester skeleton has an acid value of from 1.0 to 50.0 mgKOH/g.

It is still further preferred that, in the toner mentioned above, the resin having a polyester skeleton has a glass transition of from 35 to 65° C.

It is still further preferred that, in the toner mentioned above, the precursor of the binder resin has a portion reactive with a compound having an active hydrogen group and a polymer of the precursor has a weight average molecular weight of from 3,000 to 20,000.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
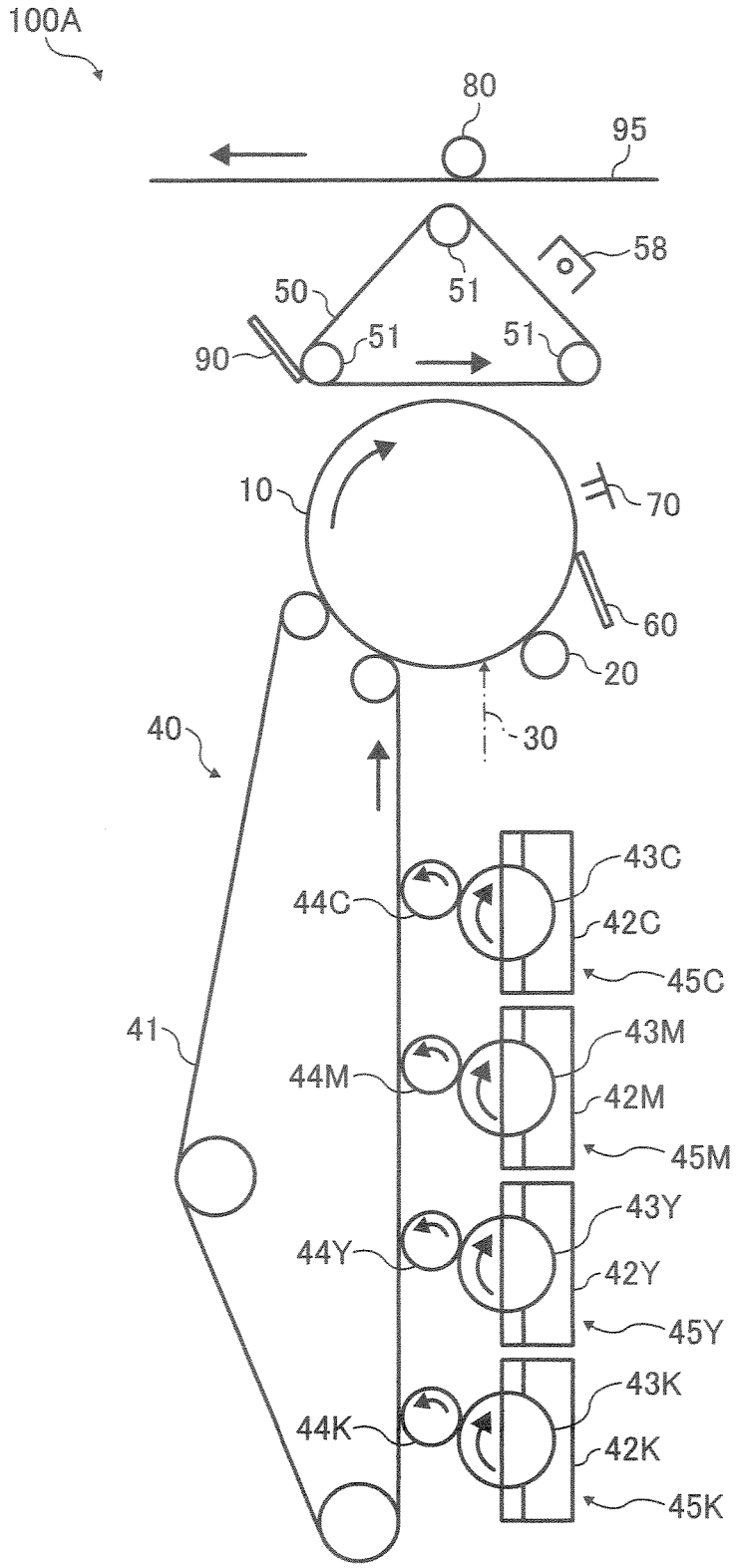
FIG. 1 is a schematic diagram illustrating an example of an image forming apparatus using the toner of the present invention.

The present invention will be described below in detail with reference to several embodiments and accompanying drawings.

The affinity of the laminar inorganic mineral to an oil phase and/or an aqueous phase depends on the kinds of ions between the layers and the level of replacement of the ions between the layers. With regard to an oil phase, the polarity of the oil phase also affects the affinity.

In the present invention, when a toner is granulated as an oil phase in an aqueous phase, the laminar inorganic mineral is modified by an organic ion to such a degree that the laminar inorganic mineral is locally present near the surface of a toner particle to a suitable level. Namely, the modified laminar inorganic mineral transfers to the surface of an oil droplet so that the modified laminar inorganic mineral tends to be locally present near the surface of a toner particle When a content of ions modified by organic ions in a modified laminar inorganic mineral is too small, the hydrophobic property of the modified laminar inorganic mineral is not sufficient. Therefore, the laminar inorganic mineral is difficult to be detached between the layers, resulting in difficulty in dispersion in a toner particle. Namely, the laminar inorganic mineral near the surface of a toner particle is not sufficiently observed.

When the content of ions that are modified by organic ions in a modified laminar inorganic mineral is increased, the kind of an organic ion is changed and/or surface treatment is conducted to improve the hydrophobic property, the modified laminar inorganic mineral tends to be uniformly dispersed in a toner particle or locally present in the center thereof.

A suitable status of a modified laminar inorganic mineral being locally present in a toner particle can be achieved by suitably selecting an aqueous phase, an oil phase and a laminar inorganic mineral.

In general, the charging property of a toner is considered to be greatly dependent on a charge controlling agent on the surface of a toner particle. In fact, a sufficient charging property can be obtained when a modified laminar inorganic mineral is locally present in a large amount in the surface of a toner particle.

With regard to a pulverization toner manufactured through kneading and pulverizing processes, additives are not locally positioned in the toner by the kneading and mixing process. Consequently, the charging property of such a pulverization toner is disadvantageous to the toner of the present invention in terms of the charging property.

When the amount of the additives is increased to compensate this disadvantage, the low temperature fixing property deteriorates as a trade-in effect, resulting in deterioration of the quality of images. In addition, a laminar inorganic mineral is not sufficiently pulverized and/or dispersed in a pulverization toner and the dispersion diameter thereof is resultantly large. Thus, the laminar inorganic mineral is detached from toner particles, which leads to increasing in the occurrence of spent. When the pulverization and/or dispersion is heavily performed, the occurrence of spent easily increases due to shearing of resins.

Surface localization can be detected by XPS, which is a photoelectron X ray that can detect the atomic density of an element existing in a particle, etc., between the surface thereof and, for example, 20 to 40 nm deep from the surface. That is, when the surface atomic density (A) of an element in the laminar inorganic mineral in atoner and the surface atomic density (B) of the element in the laminar inorganic mineral in a compound prepared by melting and kneading the toner are measured by XPS, the surface atomic density (A) is greater than the surface atomic density (B) in the case in which the laminar inorganic mineral is localized near the surface of the toner.

It is preferred to satisfy the following relationship: the surface atomic density (A)>the surface atomic density (B)× 1.4. Under this relationship, the effective of the surface localization is high and the charging property can be stably obtained by a small amount of additive.

When the surface localization of a laminar inorganic mineral can be detected by Al, the atomic density thereof is preferably greater than 0.5 atomic % in light of environment characteristics.

Since the modified laminar inorganic mineral can be localized in the surface of an oil droplet in an aqueous system, the modified laminar inorganic mineral can sufficiently perform its charging function in a small amount so that the adverse impact on the fixing ability can be minimized. Furthermore, since granulation is performed in an aqueous system, the particle can be reduced in size. Additionally, it is possible to granulate a toner by dispersing/emulsifying in aqueous and oil phases, meaning that dispersion is performed in a liquid so that the modified laminar inorganic mineral can be sufficiently dispersed.

In the present invention, with regard to a liquid containing a toner material, the toner material is preferred to be dispersed or dispersed in the solvent, which preferably contains an organic solvent. It is preferred to remove this organic solvent during or after granulation of mother toner particles.

To the contrary, the atomic density (A) of an element contained in a pulverization toner and the atomic density (B) of a toner compound prepared by fusing and kneading the pulverization toner measured by XPS in the same manner as described above satisfy the following relationship: A=B. This is because the charge controlling agent is uniformly existent in both of the pulverization and the toner compound. To stabilize and improve the charging property for such a toner, the addition amount of a charge controlling agent is increased as mentioned above, which causes side effects, for example, deterioration of the fixing property and an increase in the frequency of the occurrence of spent.

There is no specific limit to the selection of the organic solvent. The organic solvent is preferred to be volatile and have a boiling point lower than 150° to be easily removed. Specific examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methylethyl ketone and methylisobutyl ketone. Among these, toluene, xylene, benzene, methylene chloride, 1,2-dichloroethane, chloroform and carbon tetrachloride are preferred and ethyl acetate is particularly preferred. These can be used alone in combination. The content of the organic solvent is from 40 to 300 parts by weight, preferably from 60 to 140 parts by weight and more preferably from 80 to 120 parts by weight based on 100 parts by weight of a toner material.

The toner material can contain any suitable material other than a binder resin, a colorant, and a layer inorganic mineral in which part of metal ion, preferably metal cation, is modified by an organic ion, preferably an organic cation. Either a compound having a monomer, polymer and an active hydrogen group or a polymer reactive with an active hydrogen group are contained as the binder resin. A release agent and other components can be optionally added.

Next, the modified laminar inorganic mineral for use in the present invention is described.

A laminar inorganic mineral represents an inorganic mineral formed of layers having a thickness of, for example, 2 to 7 nm, which are accumulated. Modification (modified) means that organic ions are introduced as ions existing between the layers. Specific examples are described in JOPs 2006-500605, 2006-506613 and 2003-202708. This is called intercalation in a broad sense. The laminar inorganic minerals include, for example, smectites (e.g., montmorillonite, saponite), kaolin series (e.g., kaolinite), magadiite and kanemite. The modified laminar inorganic mineral has a high hydrophilic property due to its modified layered structure. When a laminar inorganic mineral is used without modification for a toner which is granulated by dispersion in an aqueous medium, the laminar inorganic mineral is transferred into the aqueous medium so that it is difficult to make the toner have an irregular form. To the contrary, a laminar inorganic mineral that is modified by organic ions can have a suitable hydrophobic property so that the ratio of the modified laminar inorganic mineral existing on the surface of toner particles increases. Thus, the toner particles easily can have an irregular form, be finely dispersed and have a sufficient charging ability.

In addition, since a modified laminar inorganic mineral hardly contributes to the low temperature fixing property of a toner, it can be considered that a modified laminar inorganic mineral that is present in the surface portion of a toner particle in an excessive amount can have an adverse impact on the low temperature fixing property. However, the modified laminar inorganic mineral can make the form of toner particles irregular and improve the charge controlling function in an excessively small amount and therefore has a good combination of form controlling, charge controlling function and the low temperature fixing property. Preferred specific examples of the modified laminar inorganic mineral for use in the present invention can be obtained by modifying a laminar inorganic mineral having a smectite type basic crystalline structure by organic cations. Smectite series clay minerals have layers having a negative polarity and positive ions are present between the layers for compensation. Compounds existing between the layers can be formed by ion exchanging of the positive ions and adhesion of polar molecules. In addition, part of the divalent metal in a laminar inorganic mineral can be replaced with trivalent metal ions to introduce metal ions. Since metal ions are hydrophilic, it is preferred to modify a laminar inorganic mineral such that an organic anion is used instead of part of the metal ions. Thus, the laminar inorganic mineral can have a suitable hydrophobic property.

Specific examples of organic ion modification agents for modifying a laminar inorganic mineral such that at least part of the ion is modified by organic ions include quaternary alkyl ammonium salts, phosphonium salts and imidazolium salts. Among these, quaternary alkyl ammonium salts are preferred. Specific examples of the quaternary alkyl ammonium salts include trimethyl stearyl ammonium, dimethyl stearyl benzyl ammonium, dimethyl octadecyl ammonium, and oleylbis(2-hydroxyethyl)methylammonium. Specific examples of the modified laminar inorganic mineral include kaolinite, laminar phosphate salts, and laminar double hydroxides. Organic ion modification agents can be suitably selected based on the polarity of layers. When a layer has a negative charge, the organic ion modification agents mentioned above can be selected. When a layer has a positive charge, branched, sulfates, sulphonic salts, carboxylic salts and phosphoric salts having non-branched or cyclic alkyl having 1 to 4 carbon atoms, an alkenyl having 1 to 22 carbon atoms, an alkoxy having 8 to 32 carbon atoms, hydroxyalkyl having 2 to 22 carbon atoms, ethylene oxide, propylene oxide, etc. can be used. Among these, carboxylic acid having an ethylene oxide skeleton is preferred.

By at least partially modifying a laminar inorganic mineral with an organic ion, the laminar inorganic mineral can have a suitable hydrophobic property. Thus, the oil phase containing a toner constituent mixture liquid has non-Newtonian viscosity and the toner particles can have an irregular form. The content of the laminar inorganic mineral part of which is modified by an organic ion is preferably from 0.05 to 5% by weight and more preferably from 0.05 to 2% by weight based on the weight of the toner material. Specific examples of the laminar inorganic mineral part of which is modified by an organic ion include montmorillonite, bentonite, hectorite, attapulgite, sepiolite and mixtures thereof. Among these, montmorillonite and bentonite are preferred since these do not affect toner characteristics, it is easy to adjust the viscosity, and the addition amount thereof can be small.

Marketed products of laminar inorganic minerals part of which is modified by an organic cation include, for example, Quaternium 18 Bentonites, e.g., BENTONE 3, BENTONE 38, BENTONE 38V (manufactured by Elementis Specialties, Inc.), TIXOGEL VP (manufactured by United Catalyst Corporation), CLAYTONE 34, CLAYTONE 40, and CLAYTONE XL (manufactured by Southern Clay Inc.); Stearal conium BENTONITE, e.g., BENTONITE 27 (manufactured by Elementis Specialties, Inc.), TIXOGEL LG (manufactured by United Catalyst Corporation), and CLAYTONE A and CLAYTONE APA (manufactured by Southern Clay Inc.); and QUATANIUM 18/BENZACONIUM BENZONITE. Among these, CLAYTONE AF and CLAYTONE APA are preferred. Particularly preferred specific examples of laminar inorganic minerals part of which is modified by an organic anion include a modified compound in which DHT-4A (manufactured by Kyowa Chemical Industry Co., Ltd.) is modified by the organic ion represented by the chemical formula 1. A specific example of the compound represented by 1 is HITENOL 330T (manufactured by DAI-ICHI KOGYO SEIYAKU CO., LTD.).

$$R_1(OR_2)_nOSO_3M \quad \text{[Chemical formula 1]}$$

In Chemical formula 1, $R_1$ represents an alkyl group having 13 carbon atoms, and $R_2$ represents an alkylene group having 2 to 6 carbon atoms. n represents an integer of from 2 to 10 and M represents a mono-valent metal element.

Since a modified laminar inorganic mineral has a suitable hydrophobic property, the modified laminar inorganic mineral tends to be present in the droplet interface portion, meaning, surface localization, and therefore a good charging property can be obtained.

In the present invention, toner can optionally contain a colorant, a release agent, a charge controlling agent, a resin particulate, inorganic particulates, a fluidity improving agent, a cleaning property improving agent, a magnetic material and metal soap.

Specific examples of the colorants include carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and mixtures thereof. Particularly preferred colorants are, for example, pigment red, e.g., PR122, PR269, PR184, PR57:1, PR238, PR146 and PR185; Pigment yellow, e.g., PY93, PY128, PY155, PY180 and PY74; and Pigment blue, e.g., PB15:3. These can be used alone or in combination.

Colorants can be dispersed in a solvent together with a binder resin or can be used as a liquid dispersion in which a colorant is dispersed in a solvent. When a colorant is dispersed, it is possible to add a binding resin, etc., to adjust the viscosity to impart a suitable shearing property.

The dispersion particle diameter of a colorant is preferably not greater than 1 μm. When a toner is prepared by using a colorant that has an excessively large dispersion particle diameter, image quality may deteriorate. Especially optical transmission of a transparent sheet easily deteriorates.

The dispersion particle diameter of a colorant can be measured by using a particle size distribution measuring device micro track super fine particle size distribution measuring device UPA-EX150 (manufactured by Nikkiso Co., Ltd.) based on the laser Doppler method.

The content of a colorant can be suitably selected and is from 1 to 15% by weight and preferably from 3 to 15% by weight. When the content of a colorant is excessively small, the coloring ability of a toner is degraded. When the content of a colorant is excessively large, pigments in a toner tend to be not sufficiently dispersed, which leads to degradation of coloring ability and deterioration of electric characteristics of a toner.

Release agents can be suitably selected from known agents and for example, waxes, polyolefin waxes, long chain hydrocarbons having a carbonyl group can be used. Waxes having a carbonyl group are preferred. These can be used alone or in combination.

Specific examples of waxes having a carbonyl group include esters having multiple alkane acid redisual groups, for example, carnauba waxes, montan waxes, trimethylolpropane tribehenate, pentaerythritol tetrabehenate, pentaerythritol diacetate dibehenate, glycerin tribehenate, and 1,18-octadecanediol distearate; esters having multiple alkanol acid residual groups, for example, tristearyl trimellitate, and distearyl maleate; and amides having multiple alkanoic acid residual group, for example, dibehenyl amides; amides having multiple monoamineresidual groups, for example, trimellitic acid tristearylamide; and dialkyl ketones, for example, distearyl ketones. Among these, esters having multiple alkonoic residual groups are particularly preferred. Specific examples of polyolefin waxes include polyethylene waxes and polypropylene waxes. Specific examples of long chain hydrocarbons include paraffin waxes and SAZOL waxes.

The waxes for use in the toner of the present invention preferably have a melting point of from 40 to 160° C., more preferably from 50 to 120° C., and even more preferably from 60 to 90° C. When the melting point of the wax included in the toner is too low, the high temperature preservation property of the toner deteriorates. In contrast, when the melting point is too high, a cold offset problem, in that an offset phenomenon occurs at a low fixing temperature, tends to occur.

The wax used in the toner of the present invention preferably has a melt viscosity of from 5 to 1,000 cps and more preferably from 10 to 100 cps at a temperature 20° C. higher than the melting point of the wax. When the melt viscosity is too high, the effect of improving the hot offset resistance and low temperature fixing property is lessened. The content of the wax in the toner preferably ranges from 0 to 40% by weight and more preferably from 3 to 30% by weight based on the total weight of the toner. When the content is too large, the fluidity of the toner may deteriorate.

Specific examples of such inorganic particulates include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc. These can be used alone or in combination.

It is preferred that the inorganic particulates have a primary particle diameter of from 5 nm to 2 μm, and more preferably from 5 nm to 500 nm. In addition, it is preferable that the specific surface area of such inorganic particulates measured by a BET method is from 20 to 500 $m^2/g$. The content of the external additive is preferably from 0.01 to 5% by weight, and more preferably from 0.01 to 2.0% by weight, based on the total weight of the toner.

When a fluidity improving agent is used for surface treatment, the hydrophobic property of the surface of a toner particle is improved so that deterioration of the fluidity and the charging property can be prevented even in a high humidity environment. Specific examples of the fluidity improving agents include silane coupling agents, silylation agents, silane coupling agents including a fluoroalkyl group, organic titanate coupling agents, aluminum coupling agents, silicone oils, and modified silicone oils.

When a cleaning property improving agent is added to a toner, developing agents remaining on an image bearing member and a primary transfer medium after transfer can be easily removed therefrom. Specific examples of the cleaning property improving agent include fatty acids and metal salts thereof, for example, zinc stearate, calcium stearate and stearic acid; resin particles which are prepared by a soap-free emulsion polymerization method or the like, for example, polymethyl methacrylate particles and polystyrene particles. The resin particles preferably have a narrow particle diameter distribution and the weight average particle diameter thereof is preferably from 0.01 to 1 μm.

Magnetic materials can be suitably selected from known materials. For example, iron powder, magnetite and ferrite can be used. Among these, white magnetic materials are preferred in terms of color tone.

In the present invention, it is preferred for an aqueous medium to contain a polymer dispersing agent. Such a polymer dispersing agent is preferably soluble in water. Specific examples of water-soluble polymers can be selected from known polymers. For example, carboxyl methyl cellulose sodium, hydroxy ethyl cellulose, and polyvinyl alcohol can be used. These can be used alone or in combination.

When a toner material is emulsified or dispersed in an aqueous medium using a liquid containing the toner material, it is preferred to disperse the liquid in the aqueous medium while stirring.

Known dispersing device can be suitably used for dispersion. For example, low speed shearing dispersion devices, high speed shearing dispersion devices, friction dispersion devices, high pressure jet dispersion devices, and ultrasonic dispersion devices can be used. Among these, high speed shearing dispersion devices are preferred because particles having a particle diameter of from 2 to 20 μm can be easily prepared.

When a high speed shearing dispersion device is used, conditions, for example, the number of rotation, dispersion time and dispersion temperature can be suitably selected. The number of rotation is preferably from 1,000 to 30,000 rpm and more preferably from 5,000 to 20,000 rpm. The dispersion time is preferably from 0.1 to 5 minutes for the batch method. The dispersion temperature is preferably from 0 to 150° C. and more preferably from 40 to 98° C. under pressure. In general, dispersion is relatively easy when the dispersion temperature is high.

Methods of forming mother toner particles can be suitably selected from known methods. For example, suspension polymerization methods, emulsification polymerization agglomeration methods, dissolution suspension methods and methods of forming mother toner particles while forming adhesive substrate material can be used. Among these, methods of forming mother toner particles while forming adhesive substrate material are preferred. Adhesive substrate materials represent substrate materials having adhesiveness to a recording medium, for example, paper.

In a suspension polymerization method, a toner material mixture is dispersed in an aqueous medium to granulate particles of the toner material mixture. The toner material mixture contains a binder resin or a monomer used as materials for a binder resin, a laminar inorganic mineral part of which is modified by an organic ion, a colorant, a wax component, a charge controlling agent, etc. The granulated toner particles have a suitable particle diameter, for example, from about 3 to about 12 μm. Thereafter, the toner particles are taken out of the aqueous medium followed by washing and drying to obtain toner.

In the method of directly obtaining toner particles by the suspension polymerization method, specific examples of the monomer for use in forming a binder resin include stylene based monomers, for example, o-(m-, p-)methyl styrene, m-(p-)ethyl styrene; (meth)acrylate based monomers, for example, methyl (meth)acrylate, ethyl(meth)acrylate, proply (meth)acrylate, butyl(meth)acrylate, octyl (meth) acrylate, dodecyl (meth) acrylate, stearyl (meth) acrylate, behenyl (meth)acrylate, 2-ethylhexyl(meth)acrylate, dimethylaminoethyl(meth)acrylate, and diethylamonoethyl (meth) acrylate; and en based monomers, for example, butadien, isoplene, cicylhexene, (meth)acrylonitrile and amide acrylates. These can be used alone or in a suitable combination of monomers having a theoretical glass transition temperature (Tg) of from 40 to 75° C. according to the Polymer Handbook Second Edition III, p 139 to p 192, published by John Wiley & Sons Co., Ltd.). A theoretical glass transition temperature that is too low tends to cause a problem on preservation stability and durability stability of a toner. A theoretical glass transition temperature that is too high tends to lead to a rise of the fixing point, resulting in deterioration of fixing property and color representation.

Cross-linking agents are preferably used to improve the mechanical strength and color representation of toner particles during synthesis of a binder resin.

Specific examples of cross linking agents for use in the toner of the present invention include cross-linking agents having two-functional groups, for example, divinyl benzene, bis(4-acryloxy polyethoxyphenyl)propane, ethylene glycol dizcrylatem 1,3-butylene glycol diacrylate, 1,4-butanediol diacrylate, 1,5-pentandioldiacrylate, 1,6-hexane diol diacrylate, neopentylglycol diacrylate, diethylene glycol diacrylate, triethylene glycol diacrylate, tetraethylene glycol diacrylate, diacrylates of polyethylene glycol # 200, #400 and #600, dipropylene glycol diacrylate, polypropylene glycol diacrylate, polyester type diacrylate (manufacture by Nippon Kayaku Co., Ltd.), and compounds prepared by substituting acrylate with methacylate in the agents mentioned above. As cross-linking agents having multiple functional groups, for example, pentaerythritol triacrylate, trimethylol ethane triacrylate, trimethylol propane triacrylate, tetramethylol methane tetraacrylate, ologoesteracrylate and a methacrylate thereof, 2,2-bis (4-methacryloxy, polyethoxyphenyl) propane, diarylphthalate, triaryl cyanulate, triaryl isocyanulate, and triaryl trimellitate.

With regard to the emulsification polymerization agglomeration method, it is effective to manufacture a toner by an emulsification polymerization agglomeration fusion method in which toner resins are prepared by emulsification polymerization and hetero-agglomerated together with a liquid dispersion containing a laminar inorganic mineral part of which is modified by an organic ion, a pigment, and release agent followed by fusion and coalescence.

The emulsification polymerization agglomeration fusion method includes a preparation process (agglomeration process) of an agglomeration particle liquid dispersion and a fusion process of heating and melting agglomerated particles to form toner particles. In the agglomeration process, a resin particulate liquid dispersion prepared by an emulsification polymerization method and another liquid dispersion separately prepared in which a laminar inorganic mineral part of which is modified by an organic ion and a colorant are contained, and an optional liquid dispersion containing a release agent are mixed to agglomerate the resin particulates, the laminar inorganic mineral part of which is modified by an organic ion and the colorant.

In the agglomeration process, agglomerated particles are formed by hetero-agglomeration, etc., and additives, for example, an ion based surface active agent having a polarity opposite to that of the agglomerated particles and one or more divalent compound, for example, a metal salt can be added to stabilize the agglomerated particles and control the particle size and particle size distribution. In the fusion process, the agglomerated particles are heated to a temperature equal to or higher than the glass transition temperature of the resin contained in the agglomerated particles.

It is possible to provide another process (adhesion process A) before the fusion process, in which other particulate liquid dispersion is added to and mixed with the agglomerated particle liquid dispersion to uniformly adhere the other particulates to the surface of the agglomerated particles. Adhesion process B can be provided in which a liquid dispersion of a laminar inorganic mineral part of which is modified by an organic ion is added to and mixed with the agglomerated particulate liquid dispersion to uniformly adhere the modified laminar inorganic mineral to the surface of the agglomerated particles. Furthermore, Adhesion process A can be provided after Adhesion process B to make the adhesion of the modified laminar inorganic mineral to the agglomerated particles stronger. These adhesion particles are formed by hetero-agglomeration, etc. The adhesion particle liquid dispersion are heated and fused to a temperature equal to or higher than the glass transition temperature of the resin contained in the agglomerated particles to form fusion particles.

The fusion particles fused in the fusion process are present as colorized fusion particle liquid dispersion in an aqueous medium. Impurities mingled from each process mentioned above are removed when the fusion particles are taken out of the aqueous medium in a washing process followed by a drying process to obtain a toner for use in developing electrostatic images.

In the washing process, acid water or hydroxyl water is added and stirred in an amount several times to that of the fusion particles The washed resultant is filtered to obtain a solid portion. Purified water is added and stirred in an amount several times to that of the solid portion followed by filtration. This procedure is repeated until the pH of the filtered liquid is about 7 to obtain colored toner particles. In the drying process, the obtained toner particles are dried under the temperature of the glass transition temperature thereof. Dried air can be circulated and/or the obtained toner particles can be heated under vacuum condition.

In the present invention, to stabilize the dispersion property of the resin particulate liquid dispersion, the colorant liquid dispersion and the release agent liquid dispersion, an alicyclic compound of an organic acid metal salt can be used. When the dispersion is not necessarily stabilized under a basic conditions due to the stability of pH for the colorant liquid dispersion and the release agent liquid dispersion and/or for the temporal stability of resin particulate liquid dispersion, it is possible to use a few amount of a surface active agent.

As the surface active agent, there can be used anionic surface active agents, for example, sulfate salt based surface active agents, sulfonate salt based surface active agents, phosphate based surface active agents, and soap based surface active agents; cationic surface active agents, for example, amine salt type surface active agents, quaternary ammonium salt based surface active agents; and non-ion surface active agents, for example, polyethylene glycol based surface active agents, adducts of alkylphenol with ethylene oxide based surface active agents and polyalcohol based surface active agents. Among these, ion surface active agents are preferred. In general, anionic surface active agents have a strong dispersion ability and are good at dispersing resin particulates and colorants. Therefore, it is preferred to use cationic surface active agents to disperse release agents. Non-ion surface active agents are preferably used in combination with anionic surface active agents or cationic surface active agents. These surface active agents can be used alone or in combination.

Specific examples of the anionic surface active agents include aliphatic acid soaps (e.g., potassium laurinate, sodium oleate, and sodium castor oil); sulfates (e.g., octyl sulfate, lauryl sulfate, lauryl ether sulfate and nonylphenyl ether sulfate; sulfate salts, for example, alkyl naphthalene sodium sulfonate (e.g., lauryl sulfonate, dodecyl benzene sulfonate, triisopropyl naphthalene sulfonate and dibuthyl naphthalene sulfonate), naphthalene sulfonate formalin condensation compound, monooctyl sulfosuccinate, dioctyl sulfosuccinate, amidesulfonate laurinate and oleic acid amide sulfonate; phosphates (e.g., lauryl phosphate, isopropyl phosphate, and nonylphenyl phosphate); and sulfosuccinate salts, for example, dialkyl sulfosuccinate salts (e.g., dioctyl sulfocuccinate sodium), and sulfosuccinates lauryl 2 sodium.

Specific examples of cationic surface active agents include amine salts (e.g., lauryl amine hydrochloric acid salts, stearyl amine hydrochloric acid salts, oleyl amine acetic acid salts, stearyl amine acetic acid salts, and stearyl amino propyl amine acetic acid salts; and tertiary amine salts (e.g., lauryl trimethyl ammonium chloride, dilauryl dimethyl ammonium chloride, distearyl ammonium chloride, distearyl dimethyl ammonium chloride, lauryl dihydroxy ethylmethyl ammonium chloride, oleyl bis polyoxy ethylene methyl ammonium chloride, lauroyl aminopropyl dimethylethyl ammonium etosulfate, lauroyl amino proopyl dimethyl hydroxy ethyl ammomonium perchlorate, alkyl benzene dimethyl ammonium chloride and alkyl trimethyl ammonium chloride.

Specific examples of non-ion surface active agents include alkyl ethers (e.g., polyoxyethylene octyl ether, polyoxyethylene lauryl ether, polyoxyethylene stearyl ether and polyoxyethylene oleyl ether); alkyl phenyl ethers (e.g., polyoxyethylene octyl phenylether and polyoxyethylene nonyl phenylether); alkylesters (e.g., polyoxyethylene laurate, polyoxyethylene stearate and polyoxyethylene oleate); alkyl amines (e.g., polyoxyethylene lauryl aminoether, polyoxyethylene stearyl aminoether, polyoxyethylene oleyl aminoether, polyoxyethylene soy aminoether, and polyoxyethylene beef fat aminoether); alkylamides (e.g., polyoxyethylene laurylate amides, polyoxyethylene stearate amides, and polyoxyethylene oleate amides; vegetable oil ethers (e.g., polyoxyethylene caster oil ether and polyoxyethylene canola oil ether; alkanol amides (e.g, diethanol laurate amide, diethanol stearate amide and diethanol oleate amide); and sorbitan ester ether (e.g., polyoxyethylene sorbitan monolaurate, polyoxyethylene sorbitan monopalmiate, polyoxyethylene sorbitan monostearate and polyoxyethylene sorbitan monooleate).

There is no specific limit to the content of such a surface active agent in each dispersion liquid as long as it does not have an adverse impact considering the present invention. Generally the content is small. The content is from about 0.01 to about 1% by weight, preferably from 0.02 to 0.5% by weight and more preferably from 0.1 to 0.2% by weight for a particulate liquid dispersion. When the content is too small, a particulate liquid dispersion may agglomerate in a state in which the pH of the particulate liquid dispersion is not sufficiently basic. The content is from about 0.01 to about 10% by weight, preferably from 0.1 to 5% by weight and more preferably from 0.5 to 2% by weight for a particulate liquid dispersion for colorant liquid dispersion and release agent liquid dispersion. A content that is too small may cause problems such that, since the stability among each particle is different during agglomeration, isolation of particular particles may occur. A content that is too large may cause problems such that the particle size distribution may be wide and controlling the particle size can be difficult.

The toner of the present invention can contain components, for example, an internal additive, a charge controlling agent, inorganic particulates, organic particulates, a lubricant and a polishing agent, in addition to the resin and the release agents mentioned above.

Internal additives are used in a range in which the charging property of a toner is not damaged. Magnetite, for example, metals (e.g., ferrite, magnetite, reduced iron, cobalt, manganese and nickel), alloyed metals and compounds containing these metals, can be used.

There is no specific limit to the charge controlling agent and transparent or light colored agents are preferably used especially for a color toner. For example, dyes formed of a complex, for example, tertiary ammonium salt compounds, nigrosine compounds, aluminum, ferrite and chromium and triphenyl methane pigments can be used.

Specific examples of inorganic particulates include all the particles which can be used as external additives, for example, silica, titania, calcium carbide, magnesium carbide, tricalcium phosphate, and cerium oxide, to the surface of a toner. Specific examples of organic particulates include all the particles which can be used as external additives, for example, vinyl resins, polyester resin and silicone resins, to the surface of a toner. These inorganic and organic compounds can be used as a fluidity improving agent, a cleaning property improving agent, etc. Specific examples of lubricants include, for example, aliphatic acid amides (e.g., ethylene bis stearate amide and oleic acid amides) and metal salts of aliphatic acids (e.g., zinc stearate, and calcium stearate). Specific examples of abrasive agent include silica, alumina and cerium oxide.

The content of a coloring agent is not greater than 50% by weight and preferably ranges from 2 to 40% by weight when a resin particulate liquid dispersion, an at least partially organic-ion modified laminar inorganic mineral liquid dispersion, a colorant liquid dispersion and a releasing agent liquid dispersion are mixed. The content of the at least partially organic-ion modified laminar inorganic mineral liquid dispersion preferably ranges from 0.05 to 10% by weight. Any content of other components is allowed as long as the content has no damage to the objective of the present invention. Generally, the content is excessively small and ranges from 0.01 to 5% by weight and preferably from 05 to 2% by weight.

In the present invention, for example, an aqueous medium can be used as a dispersing solvent for a resin particulate liquid dispersion, an at least partially organic-ion modified laminar inorganic mineral liquid dispersion, a colorant liquid dispersion, a releasing agent liquid dispersion and other component liquid dispersion. Specific examples of such an aqueous medium include distillated water, water (e.g., deionized water), and alcohol. These media can be used alone or in combination.

In the process of preparing an agglomeration particle liquid dispersion, the emulsification ability of an emulsification agent can be adjusted for agglomeration to control agglomerated particles. An agglomeration agent can be added to stably and promptly agglomerate particles having a narrow size distribution. Single or multivalent compounds are preferred as the agglomeration agent. Specific examples thereof include the ionic surface agents mentioned above, nonionic surface active agents mentioned above, acids (e.g., hydrochloric acid, a sulfuric acid, nitric acid, acetic acid and oxalic acid), metal salts of organic acids (e.g., magnesium chloride, sodium chloride, aluminum sulfate, calcium sulfate, ammonium sulfate, aluminum nitrate, silver nitrate, copper sulfate, sodium carbonate, potassium formate, sodium oxalate and sodium acetate, metal salt salts of aliphatic acids and aromatic acids (e.g., sodium phthalate and potassium salicylate), metal salts of phenols (e.g., sodium phenolate), metal salts of amino acids, and inorganic acid salts (e.g., triethanol amine hydrochloric acid salts and aniline hydrochloric acid salts). Metal salts of inorganic acids are preferred in terms of performance and usage considering stability of agglomerated particles, stability to heat of an agglomeration agent over time and removal by washing.

The addition amount of such an agglomeration agent depends on the number of valence and is small, for example, not greater than 3% by weight in the case of mono-valence, 1% by weight in the case of di-valence, and 0.5% by weight in the case of tri-valence. It is preferred to add such an agglomeration agent in a small amount and compounds having a higher valence are preferred because the addition amount can be made small.

The method by which mother toner particles are formed while forming an adhesive substrate material is a method in which mother toner particles are formed by reacting a compound having active hydrogen groups and a polymer reactive with active hydrogen in an aqueous medium. The compound and the polymer are contained in a toner material. While the reaction progresses, adhesive substrate materials are formed. This adhesive substrate material can contain known binder resin.

The thus obtained toner preferably contains a colorant and a suitably selected optional component, for example, a release agent and a charge controlling agent.

The weight average particle molecular weight of an adhesive substrate material is preferably not less than 3,000, more preferably from 5,000 to 1,000,000 and particularly preferably from 7,000 to 500,000. A weight average molecular weight that is too small may lead to deterioration of anti-hot-offset property.

The glass transition temperature of an adhesive substrate material is preferably from 30 to 70° C. and more preferably from 40 to 65° C. A glass transition temperature that is too low may degrade the heat resistance preservation property of a toner. A glass transition temperature that is too high may result in insufficiency of low temperature fixing property. A toner that has a cross-linked or elongated polyester resin as an adhesive substrate material has a good preservation property even when the glass transition temperature is low.

The glass transition temperature can be measured by using TG-DSC system TAS-100 (manufactured by (Rigaku Corporation) as follows: Place about 10 mg in an aluminum sample container; Place the sample container on a holder unit; Set the container and the holder unit in an electric furnace; Heat the container from room temperature to 150° C. at a temperature raising rate of 10° C./min. Let the container stand for 10 minutes down to room temperature; Subsequent to letting it stand for another 10 minutes, heat the container again to 150° C. at a temperature raising ratio of 10° C./min in a nitrogen atmosphere for DSC measurement; and calculate Tg from the intersection of the tangent of the endothermic curve around TG and the base line using the analysis system in TAS-100 system.

Adhesive substrate materials are suitably selected. Polyester resins are preferably used as the adhesive substrate material and urea modified polyester resins are preferably used.

Urea modified polyester resins are obtained by reacting an amine as a compound having an active hydrogen group and a polyester prepolymer having an isocyanate group as a polymer reactive with an active hydrogen group in an aqueous medium. It is possible to add an alcohol in addition to an amine to form a urethane linkage when synthesizing a urea-modified polyester resin. To distinguish the urethane linkage contained in a polyester prepolymer having an isocyanate group, the molar ratio of the urethane linkage to the urea linkage is preferably from 0 to 9, more preferably from 1/4 to 4 and particularly preferably from 2/3 to 7/3. When the ratio is too large, the anti-hot offset may deteriorate.

Specific examples of the adhesive substrate material include;

1. A mixture of a polycondensation compound of an adduct of bisphenol A with 2 mol of ethylene oxide and isophthalic acid and a compound obtained by urea-modifying with isophorone diamine a polyester prepolymer prepared by reacting a polycondensation compound of an adduct of bisphenol A with 2 mol of ethylene oxide and isophthalic acid with isophorone diisocyanate);

2. A mixture of a polycondensation compound of an adduct of bisphenol A with 2 mol of ethylene oxide and terephthalic acid and a compound obtained by urea-modifying with isophorone diamine a polyester prepolymer prepared by reacting a polycondensation compound of an adduct of bisphenol A with 2 mol of ethylene oxide and isophthalic acid with isophorone diisocyanate);

3. A mixture of a polycondensation compound of an adduct of bisphenol A with 2 mol of ethylene oxide, an adduct of bisphenol A with 2 mol of propylene oxide and terephthalic acid and a compound obtained by urea-modifying with isophorone diamine a polyester prepolymer prepared by reacting a polycondensation compound of an adduct of bisphenol A with 2 mol of ethylene oxide, an adduct of bisphenol A with 2 mol of propylene oxide and terephthalic acid with isophorone diisocyanate;

4. A mixture of a polycondensation compound of an adduct of bisphenol A with 2 mol of propylene oxide and terephthalic acid and a compound obtained by urea-modifying with isophorone diamine a polyester prepolymer prepared by reacting a polycondensation compound of an adduct of bisphenol A with 2 mol of ethylene oxide, an adduct of bisphenol A with 2 mol of propylene oxide and terephthalic acid with isophorone diisocyanate);

5. A mixture of a polycondensation compound of an adduct of bisphenol A with 2 mol of ethylene oxide and terephthalic acid and a compound obtained by urea-modifying with hexamethylene diamine a polyester prepolymer prepared by reacting a polycondensation compound of an adduct of bisphenol A with 2 mol of ethylene oxide and terephthalic acid with isophorone diisocyanate;

6. A mixture of a polycondensation compound of an adduct of bisphenol A with 2 mol of ethylene oxide, an adduct of bisphenol A with 2 mol of propylene oxide and terephthalic acid and a compound obtained by urea-modifying with hexamethylene diamine a polyester prepolymer prepared by reacting a polycondensation compound of an adduct of bisphenol A with 2 mol of ethylene oxide and terephthalic acid with isophorone diisocyanate;

7. A mixture of a polycondensation compound of an adduct of bisphenol A with 2 mol of ethylene oxide and terephthalic acid and a compound obtained by urea-modifying with ethylene diamine a polyester prepolymer prepared by reacting a polycondensation compound of an adduct of bisphenol A with 2 mol of ethylene oxide and terephthalic acid with isophorone diisocyanate;

8. A mixture of a polycondensation compound of an adduct of bisphenol A with 2 mol of ethylene oxide and isophthalic acid and a compound obtained by urea-modifying with hexamethylene diamine a prepolymer prepared by reacting a polycondensation compound of an adduct of bisphenol A with 2 mol of ethylene oxide and isophthalic acid with diphenyl methane diisocyanate;

9. A mixture of polycondensation compound of an adduct of bisphenol A with 2 mol of ethylene oxide, an adduct of bisphenol A with 2 mol of propylene oxide and terephthalic acid and a compound obtained by urea-modifying with hexamethylene diamine a polyester prepolymer prepared by reacting a polycondensation compound of an adduct of bisphenol A with 2 mol of ethylene oxide, an adduct of bisphenol A with 2 mol of propylene oxide, terephthalic acid and dodecenyl succinic anhydride with diphenyl methane diisocyanate; and 10. a mixture of a polycondensation compound of an adduct of bisphenol A with 2 mol of ethylene oxide and isophthalic acid and a compound obtained by urea-modifying with hexamethylene diamine a prepolymer prepared by reacting a polycondensation compound of an adduct of bisphenol A with 2 mol of ethylene oxide and isophthalic acid with toluene diisocyanate.

The compound having an active hydrogen group functions as an elongation agent, a cross linking agent, etc., when a polymer reactive with an active hydrogen group conducts an elongation reaction and/or a cross-linking reaction in an aqueous medium.

Specific examples of the active hydrogen group include hydroxyl group (alcoholic hydroxyl group and phenolic hydroxyl group), amino group, carboxyl group, and mercapto group. These active hydrogen groups can be used alone or in combination.

Compounds having an active hydrogen group can be suitably selected. When a polymer reactive with an active hydrogen group is a polyester prepolymer having an isocyanate group, amines are suitable since polyester polymers obtained from an elongation reaction and/or a cross linking reaction between the polyester prepolymer and the amines can have a large molecular weight.

Amines can be suitably selected. Specific examples of the amines include diamines, polyamines having three or more amino groups, amino alcohols, amino mercaptans, amino acids, and blocked amines in which the amine groups of the amines mentioned above are blocked. Diamines and a mixture of a diamine with a small amount of polyamines are preferred. These can be used alone or in combination.

Specific examples of the diamines include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine and hexamethylene diamine); etc.

Specific examples of the polyamines having three or more amino groups include diethylene triamine, triethylene and tetramine. Specific examples of the amino alcohols include ethanol amine and hydroxyethyl aniline. Specific examples of the amino mercaptan include aminoethyl mercaptan and aminopropyl mercaptan. Specific examples of the amino acids include amino propionic acid and amino caproic acid. Specific examples of the blocked amines include ketimine compounds and oxazoline compounds, which are obtained by blocking one of the amines mentioned above with a ketone, for example, acetone, methyl ethyl ketone and methyl isobutyl ketone.

To stop the elongation reaction and/or the cross-linking reaction between a compound having an active hydrogen group and a polymer reactive with an active hydrogen group, a reaction inhibiting agent can be used. When a reaction inhibiting agent is used, it is possible to control the molecular weight, etc., of an adhesive substrate material within a desired range. Specific examples of reaction inhibiting agents include monoamines, for example, diethylamine, dibutylamine, butylamine and laurylamine and blocked amines (i.e., ketimine compounds) prepared by blocking the monoamines mentioned above.

The mixing ratio (i.e., a ratio [NCO]/[NHx]) of the content of the isocyanate group of a polyester prepolymer to the amino group of an amine is preferably from 1/3 to 3/1, more preferably from 1/2 to 2 and particularly preferably from 2/3 to 1.5. When the mixing ratio is too low, the low temperature fixing property may deteriorate. When the mixing ratio is too high, the molecular weight of the resultant urea-modified polyester decreases, resulting in deterioration of the anti-hot offset property.

Polymers reactive with an active hydrogen group (hereinafter referred to as prepolymer) can be suitably selected from known resins. For example, polyol resins, polyacryl resins, polyester resins, epoxy resins and derivatives thereof can be used. Among them, it is preferred to use polyester resins in terms of high fluidity and transparency during melting. These can be used alone or in combination.

Specific examples of functional groups reactive with the active hydrogen group contained in a prepolymer include isocyanate group, epoxy group, carboxyl group and functional group represented by the following chemical structure: —COCl. Among these, isocyanate group is preferred. The prepolymer can have one or more functional groups mentioned above.

As a prepolymer, it is preferred to use a polyester resin having, for example, an isocyanate group, which can produce an urea linkage, since the molecular weight of a polymer component can be easily controlled and oilless low temperature fixing property and releasing property of a drying toner can be secured even when there is no releasing oil application mechanism to a heating medium for fixing.

Polyester prepolymer having an isocyanate group can be suitably selected. Specifically, there can be used a resultant product of the reaction between polyisocyanate and a polyester resin having an active hydrogen group obtained by polycondensing a polyol and a poly-carboxylic acid.

Polyols can be suitably selected. For example, diols, polyols having three or more hydric group and a mixture of dials and polyols having three or more hydric groups can be used. A mixture of dial with a small amount of polyols having three or more hydric groups is preferred. These can be used alone or in combination.

Specific examples of dials include alkylene glycol (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic dials (e.g., 1,4-cyclohexane dimethanol and hydrogenated bisphenol A); bisphenols (e.g., bisphenol A, bisphenol F and bisphenol S); adducts of the alicyclic dials mentioned above with an alkylene oxide (e.g., ethylene oxide, propylene oxide and butylene oxide); adducts of the bisphenols mentioned above with an alkylene oxide (e.g., ethylene oxide, propylene oxide and butylene oxide); etc. Alkylene glycols preferably have 2 to 12 carbon atoms and adducts of bisphenols with an alkylene oxide are preferred. Among these, alkylene glycols having 2 to 12 carbon atoms or an adduct of bisphenols with an alkylene oxide are preferred. An adduct of bisphenols with an alkylene oxide and a mixture of an adduct of bisphenols with an alkylene oxide and an alkylene glycol having from 2 to 12 carbon atoms are more preferred.

Specific examples of the polyols having three or more hydroxyl groups include aliphatic alcohols having three or more phenol groups, polyphenols having three or more phenol groups, and adducts of polyphenols having three or more phenol groups with alkylene oxide. Specific examples of aliphatic alcohols having three or more alcohol groups include glycerin, trimethylol ethane, trimethylol propane, pentaerythritol and sorbitol. Specific examples of polyphenols having three or more phenol groups include trisphenol PA, phenol novolak and cresol novolak. Specific examples of adducts of the polyphenols with an alkylene oxide include adducts of polyphenols having three or more phenol groups with an alkylene oxide, for example, ethylene oxidem propylene oxide and butylene oxide.

When a diol and an alcohol having three or more phenol groups are used, the weight ratio of the alcohol having three or more phenol groups to the diol is preferably from 0.01 to 10% and more preferably from 0.01 to 1%.

Polycarboxylic acids can be suitably selected. For example, dicarboxylic acids, carboxylic acids having three or more carboxyl groups and a mixture thereof can be used. Among these, the mixture is preferred. These can be used alone or in combination.

Specific examples of the dicarboxylic acids include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acids having three or more hydroxyl groups include aromatic polycarboxylic acids having from 9 to 20 carbon atoms (e.g., trimellitic acid and pyromellitic acid). As the polycarboxylic acid, anhydrides or lower alkyl esters (e.g., methyl esters, ethyl esters or isopropyl esters) of the polycarboxylic acids mentioned above can be used.

When a dicarboxylic acid and a polycarboxylic acid having three or more carboxylic groups are mixed for use, the weight ratio of the three or more carboxylic groups to the dicarboxylic acid is preferably from 0.01 to 10% and more preferably from 0.01 to 1%.

With regard to the mixing ratio of a polyol and a polycarboxylic acid when the polyol and the polycarboxylic acid are poly-condensed, the ratio of the hydroxyl group of the polyol to the carboxyl group of the polycarboxylic acid is preferably from 1 to 2, more preferably from 1 to 1.5 and particularly preferably from 1.02 to 1.3.

The content of the composition unit from polyols in a polyester prepolymer having an isocyanate group is preferably from 0.5 to 40% by weight, more preferably from 1 to 30% by weight and particularly preferably from 2 to 20% by weight. When the content is too small, anti-hot offset property deteriorates, which may result in bad combination of heat resistance preservation property and low temperature fixing property of a toner. When the content is too large, the low temperature fixing property may deteriorate.

Polyisocyanates can be suitably selected. Specific examples of the polyisocyanates include aliphatic diisocyanates, alicyclic diisocyanates, aromatic diisoycantes, aromatic aliphatic diisocyanates, isocyanurates, blocked polyisocyanates in which the polyisocyanates mentioned above are blocked with phenol derivatives, oximes or caprolactams.

Specific examples of aliphatic diisocyanates include tetramethylene diisocyanate, hexamethylene diisocyanate, 2,6-diisocyanate methylcaproate, octamethylene diisocyanate, decamethylene diisocyanate, dodecemethylene diisocyanate, tetradecamethylene diisocyanate, trimethyl hexane diisocyanate and tetramethyl hexane diisocyanate. Specific examples of alicyclic diisocyanates include isophorone diisocyanate and cyclohexylmethane diisocyanate. Specific examples of aromatic diisoycantes include tolylene diisocyanate, diphenylmethane diisocyanate, 1,5-naphtylene diisocyanate, 4,4'-diisocyanate diphenyl, 4,4'-diisocyanate-3,3'-dimethyl diphenyl, 4,4'-diisocyanate-3-methyldiphenyl methane, and 4,4'-diisocyanate-diphenyl ether. Specific examples of aromatic aliphatic diisocyanates include α, α, α', α'-tetramethyl xylylene diisocyanate. Specific examples of isocyanurates include tris(isocyanate alkyl)isocyanurate and tris(isocyanate cycloalkyl) isocyanulate. These can be used alone or in combination.

When a polyisocyanate and a polyester resin having a hydroxyl group are reacted, the mixing ratio of the isocyanate group in the polyisocyanate to the hydroxyl group in the polyester resin preferably ranges from 1 to 5, more preferably from 1.2 to 4 and particularly preferably from 1.5 to 3. When the ratio is too large, the low temperature fixing property of the toner may deteriorate. In contrast, when the ratio is too small, anti-hot offset property may deteriorate. The content of the component unit of polyisocyanate in a polyester prepolymer having an isocyanate group preferably ranges from 0.5 to 40% by weight, more preferably from 1 to 30 by weight and particularly preferably from 2 to 20% by weight. When the content is too low, the anti-hot offset property may deteriorate. In contrast, when the content is too high, the low temperature fixing property may deteriorate.

The average number of isocyanate groups per porepolymer molecule is preferably not less than 1, preferably from 1.2 to 5 and particularly preferably from 1.5 to 4. An average number that is too small decreases the molecular weight of a urea-modified polyester resin, which may lead to deterioration of anti-hot offset property.

The weight average molecular weight of a polymer reactive with an active hydrogen active group is preferably from 1,000 to 30,000 and more preferably from 1,500 to 15,000. When the weight average molecular weight is too small, the heat resistance preservation property may deteriorate. When the weight average molecular weight is too high, the low temperature fixing property may deteriorate. The weight average molecular weight can be obtained by measuring tetrahydrofuran soluble portion using Gel Permeation Chromatography (GPC).

GPC measuring can be performed, for example, as follows: Stabilize a column in a heat chamber at 40° C.; Flow tetrahydrofuran at 1 ml per minute as the column solvent at this temperature; Pour 50 to 200 μl of tetrahydrofuran solution in which the density of a sample is adjusted to 0.05 to 0.6% by weight for measurement. The molecular weight is calculated using the relationship between the logarithm value of the analytical curve made based on several kinds of standard samples and the count number. As the standard sample used for making the analytical curve, simple dispersion polystyrene (manufactured by Pressure Chemical Co., Ltd. or Toso Corporation) $6\times10^2$, $2.1\times10^2$, $4\times10^2$, $1.75\times10^4$, $1.1\times10^5$, $3.9\times10^5$, $8.6\times10^5$, $2\times10^6$ and $4.48\times10^6$ can be used. It is preferred to use about 10 kinds of standard samples. A refraction detector can be used as the detecting device.

In the present invention, binder resins can be suitably selected and polyester resins can be used. It is preferred to use non-modified polyester resins in terms of the low temperature fixing property and gloss property.

Specific examples of such non-modified polyester resins include polycondensation products of polyols and polycarboxylic acids. Non-modified polyester resins that are partially compatible with urea-modified polyesters are preferred. Namely, it is preferred for non-modified polyester resins to have a similar structure to urea-modified polyester resins in terms of the low temperature fixing property and anti-hot offset property.

The weight average molecular weight of non-modified polyester resins is preferably from 1,000 to 30,000 and more preferably from 1,500 to 15,000. When the weight average molecular weight is too small, the heat resistance preservation property may deteriorate. Therefore, the content of non-modified polyester resin having an excessively small molecular weight is preferably from 8 to 28% by weight. A weight average molecular weight that is too large may cause deterioration of the low temperature fixing property.

The glass transition temperature of such a non-modified polyester resin is from 30 to 70° C., preferably from 35 to 60° C. and more preferably from 35 to 55° C. When the glass transition temperature is too low, the heat resistance preservation property of a toner may deteriorate. When the glass transition temperature is too high, the low temperature fixing property may deteriorate.

The hydroxyl value of such a non-modified polyester resin is preferably not less tan 5 mgKOH/g, more preferably from 10 to 120 mgKOH/g and particularly preferably from 20 to 80 mgKOH/g. When the hydroxyl value is too small, it may be difficult to have a good combination of heat resistance preservation property and low temperature fixing property.

The acid value of such a non-modified polyester resin is preferably from 1.0 to 50.0 mgKOH/g and more preferably from 1.0 to 30.0 mgKOH/g. According to this, a toner is easily negatively charged.

When a toner contains a non-modified polyester resin, the weight ratio of a polyester prepolymer having an isocyanate group to a non-modified polyester resin is preferably from 5/95 to 25/75, more preferably from 10/90 to 25/75. When the weight ratio is too low, anti-hot offset property may deteriorate. When the weight ratio is too high, low temperature fixing property and gloss property may deteriorate.

Any resin particulates can be used as long as the resin can form an aqueous liquid dispersion in an aqueous medium and can be selected from known resins. Specific examples of these resins include thermoplastic resins and thermosetting resins. For example, vinyl resins, polyurethane resins, epoxy resins, polyester resins, polyamide resins, polyimide resins, silicone resins, phenolic resins, melamine resins, urea resins, aniline resins, ionomer resins, and polycarbonate resins. These resins can be used alone or in combination. Among these resins, vinyl resins, polyurethane resins, epoxy resins, polyester resins, and mixtures thereof are preferably used because an aqueous dispersion including fine spherical particles can be easily prepared.

Specific examples of the vinyl resins include polymers, which are prepared by polymerizing a vinyl monomer or copolymerizing vinyl monomers, for example, styrene-(meth)acrylate resins, styrene-butadiene copolymers, (meth) acrylic acid-acrylate copolymers, styrene-acrylonitrile copolymers, styrene-maleic anhydride copolymers and styrene-(meth)acrylic acid copolymers.

It is possible to use copolymers obtained by coplymerizing monomers having multiple unsaturated groups as the resin particulate. Monomers having multiple unsaturated groups can be suitably selected. Specific examples include sodium salt of sulfate of an adduct of methacrylic acid with ethyleneoxide (EREMINOR RS-30 from Sanyo Chemical Industries Ltd.), divinyl benzene, and 1,6-hexane diol diacrylate.

Resin particulates can be obtained through polymerization using any known method. It is preferred to use an aqueous liquid dispersion of resin particulates. Preparation methods of an aqueous liquid dispersion of resin particulates are, for example, as follows:

In the case of a vinyl resin, a method in which an aqueous liquid dispersion is prepared by polymerizing vinyl monomers using a suspension polymerization method, an emulsification polymerization method, a seed polymerization method or a dispersion polymerization method;

In the case of polyaddition or polycondensation resins, for example, polyester resins, polyurethane resins and epoxy resins, a method in which an aqueous liquid dispersion is prepared by dispersing precursors of monomers and oligomers or a solution thereof in an aqueous medium under a suitable dispersing solvent followed by curing upon application of heat or addition of an curing agent;

A phase change emulsification method in which an aqueous liquid dispersion is prepared by dissolving a suitable emulsification agent in precursors of monomers and oligomers or a solution thereof and adding water;

A method in which an aqueous liquid dispersion is prepared by pulverizing and classifying resins with, for example, a mechanical rotation type fine pulverization device or a jet type fine pulverization device to obtain resin particulates and dispersing the resin particulates in water under the presence of a suitable dispersing agent;

A method in which an aqueous liquid dispersion is prepared by spraying a resin solution in a foggy manner to obtain resin particulate and dispersing the resin particulates in water under the presence of a suitable dispersing agent;

A method in which an aqueous liquid dispersion is prepared by adding a poor solvent to a resin solution, or cooling down a resin solution prepared by heating and dissolving a resin in a solvent to precipitate resin particulates and to remove the solvent to obtain resin particulates and dispersing the resin particulates in water under the presence of a suitable dispersing agent;

A method in which an aqueous liquid dispersion is prepared by dispersing a resin solution in an aqueous medium under the presence of a suitable dispersing agent followed by heating or pressure reduction to remove the solvent; and A phase change emulsification method which an aqueous liquid dispersion is prepared by dissolving a suitable emulsification agent in a resin solution and adding water.

Below is a description of a method of forming mother toner particles while forming an adhesive substrate material.

Such a method includes preparation of an aqueous medium phase, preparation of liquid containing toner materials, emulsification or dispersion of a toner material, formation of adhesive substrate material, removal of solvent, polymerization of a polymer reactive with an active hydrogen group and synthesis of a compound having an active hydrogen group.

An aqueous medium phase can be prepared by dispersing resin particulates in an aqueous medium. The addition amount of resin particulates in an aqueous medium is preferably from 0.5 to 10% by weight.

Liquid containing toner materials can be prepared by dissolving or dispersing in a solvent a toner material, for example, a compound having an active hydrogen group, a polymer reactive with an active hydrogen group, a rheology additive, a colorant, a release agent, a charge controlling agent and a non-modified polyester resin.

The component mentioned above except for the polymer reactive with an active hydrogen group can be added or mixed in an aqueous medium when particulate resins are dispersed in an aqueous medium or can be added when the liquid containing the toner material is added in an aqueous medium.

A toner material can be emulsified or dispersed by dispersing a liquid containing a toner material in an aqueous medium. When a toner material is emulsified or dispersed, an adhesive substrate material can be formed by conducting an elongation reaction and/or a cross-linking reaction of a compound having an active hydrogen group and a polymer reactive with an active hydrogen group.

An adhesive substrate material of a urea-modified polyester resin can be formed by, for example:

Emulsifying or dispersing a liquid containing a polymer reactive with an active hydrogen group (e.g., a polyester prepolymer having an isocyanate group) and a compound having an active hydrogen group (e.g., amines), in an aqueous medium to conduct an elongation reaction and/or a cross-linking reaction in the aqueous medium;

Emulsifying or dispersing a liquid containing a toner material in an aqueous medium in which a compound having an active hydrogen group is added to conduct an elongation reaction and/or a cross-linking reaction in the aqueous medium; or Emulsifying or dispersing a liquid containing a toner material in an aqueous and adding a compound having an active hydrogen group thereto to conduct an elongation reaction and/or a cross-linking reaction in the aqueous medium from the particle interface.

When an elongation reaction and/or a cross-linking reaction is conducted in an aqueous medium from the particle interface, a urea-modified polyester resin is preferentially formed on the surface of a toner particle, meaning that gradient of the concentration of the modified polyester resin can be generated in the thickness direction of a toner particle.

The reaction conditions for forming an adhesive substrate material can be suitably selected depending on the combination of a compound having an active hydrogen group and a polymer reactive with an active hydrogen group. The reaction time is preferably from 10 minutes to 40 hours and more preferably from 2 to 24 hours. The reaction temperature is preferably from 0 to 150° C. and more preferably from 40 to 98° C.

Specific examples of methods of stably forming a liquid dispersion containing a polymer reactive with an active hydrogen group (e.g., a polyester prepolymer having an isocyanate group) in an aqueous medium include a method in which a liquid prepared by dissolving or dispersing a toner material containing, for example, a compound having an active hydrogen group, a colorant, a release agent, a charge controlling agent and a non-modified polyester resin, is added to an aqueous medium phase and the resultant is sheared for dispersion.

Known dispersing device can be used for dispersion. For example, low speed shearing dispersion devices, high speed shearing dispersion devices, friction dispersion devices, high pressure jet dispersion devices, and ultrasonic dispersion devices can be used. Among these, high speed shearing dispersion devices are preferred because particles having a particle diameter of from 2 to 20 μm can be easily prepared.

When a high speed shearing dispersion device is used, conditions, for example, the number of rotation, dispersion time and dispersion temperature, can be suitably selected. The number of rotation is preferably from 1,000 to 30,000 rpm and more preferably from 5,000 to 20,000 rpm. The dispersion time is preferably from 0.1 to 5 minutes for the batch method. The dispersion temperature is preferably from 0 to 150° C. and more preferably from 40 to 98° C. under pressure. In general, dispersion is relatively easy when the dispersion temperature is high.

When a toner material is emulsified or dispersed, the content of an aqueous medium is preferably from 50 to 2,000 parts by weight and more preferably from 100 to 1,000 parts by weight based on 100 parts of the toner material. A content that is too small causes deterioration of the dispersion status of a toner material and the resultant mother toner particle may not have a desired particle diameter. A content that is too large causes a rise in production cost.

In the process of emulsifying or dispersing a liquid containing a toner material, it is preferred to use a dispersing agent to stabilize a dispersion body, for example, an oil droplet, to obtain a desired form of toner particles, and to make the size distribution sharp.

Dispersing agents can be suitably selected and a surface active agent, an inorganic dispersing agent hardly soluble in water, and a polymeric protection colloid can be used. Among these, a surface active agent is preferred. These can be use alone or in combination.

Specific examples of surface active agents include anionic surface active agents, cationic surface active agents and non-ion active agents and ampholytic surface active agents.

Specific examples of anionic surface active agents include alkylbenzene sulfonic acid salts, α-olefin sulfonic acid salts, and phosphoric acid salts and an anionic surface active agent having a fluoroalkyl group is preferably used. Specific examples of such an anionic surface active agent having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4) sulfonate, sodium 3-{omega-fluoroalkanoyl(C6-C8)-N-ethylamino}-1-propanesulfonate, fluoroalkyl(C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin, and monoperfluoroalkyl(C6-C16) ethylphosphates.

Specific examples of the marketed products of such surfactants having a fluoroalkyl group include SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; and FUTARGENT F-100 and F150 manufactured by Neos.

Specific examples of cationic surface agent include amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride). Preferred specific examples of cationic surface agent include primary, secondary and tertiary aliphatic amines having a fluoroalkyl group, aliphatic quaternary ammonium salts, for example, perfluoroalkyl(C6-C10) sulfoneamidepropyltrimethylammonium salts, benzalkonium salts, benzetonium chloride, pyridinium salts, imidazolinium salts, etc. Specific examples of the marketed products thereof include SURFLON S-121 (from Asahi Glass Co., Ltd.); FRORARD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); and FUTARGENT F-300 (from Neos).

Specific examples of nonionic surface agents include aliphatic acid amide derivatives and polyhydric alcohol derivatives. Specific examples of ampholytic surface active agents include alanine, dodecyldi(aminoethyl)glycin, di(octylaminoethyle)glycin, and N-alkyl-N,N-dimethyl ammonium betaine.

Specific examples of inorganic dispersing agents hardly soluble in water include tricalcium phosphate, calcium carbonate, titanium oxide, colloidal silica, and hydroxyapatite.

Specific examples of polymeric protection colloids include a homopolymer or copolymer obtained by polymerizing a monomer having a carboxyl group, alkyl (meth)acrylate having a hydroxyl group, vinyl ether, vinyl carboxylate, an amide monomer, a monomer of acid salts, and a monomer having a nitrogen group or a heterocyclic ring having an nitrogen atom, polyoxyethylene resins and cellulose resins. The homopolymers or copolymers obtained by polymerizing the monomers mentioned above include polymers having a composition unit originating from vinyl alcohol.

Specific examples of monomers having a carboxyl group include acids (e.g., acrylic acid, methacrylic acid, α-cyanoacrylic acid, α-cyanomethacrylic acid, itaconic acid, crotonic acid, fumaric acid, maleic acid and maleic anhydride), (meth)acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds; acid chlorides (e.g., acrylic acid chloride and methacrylic acid chloride); and monomers having a nitrogen atom or an alicyclic ring having a nitrogen atom (e.g., vinyl pyridine, vinyl pyrrolidone, vinyl imidazole and ethylene imine).

In addition, polymers, for example, polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene pelargonic phenyl); and cellulose compounds, for example, methyl cellulose, hydroxyethyl cellulose and hydroxypropyl cellulose, can also be used as the polymeric protective colloid.

Dispersing agents can be optionally used when a toner material is emulsified or dispersed. Specific examples of such dispersing agents include compounds, for example, calcium phosphate, which are soluble in an acid and/or alkali. When a compound, for example, calcium phosphate, is used, it is possible to dissolve the compound by adding an acid, for example, hydrochloric acid, followed by washing of the resultant particles with water, to remove the compound. In addition, a zymolytic method can be used to remove such a compound.

A catalyst can be used for the elongation reaction and/or the cross-linking reaction when an adhesive substrate material is used. Specific examples of catalyst include dibutyl tin laurate, and dioctyl tin laurate.

Specific examples of removing an organic solvent from a liquid dispersion, for example, an emulsion slurry, include a method of gradually heating a reaction system to evaporate the organic solvent in oil droplets; and a method of spraying a liquid dispersion in a dried atmosphere to remove the organic solvent in oil droplets.

When the organic solvent is removed, mother toner particles are formed. The mother toner particles can be washed and dried. Also, the mother toner particles can be classified. Classification can be performed by removing particulates in a liquid by a cyclone, a decanter or a method utilizing a centrifuge and can also be done by a classification operation after drying.

The thus prepared mother toner particles can be mixed with other particles, for example, a colorant, a release agent and a charge controlling agent. Such other particles can be fixed and integrated into the surface of toner particles by applying a mechanical impact thereto. It is thus possible to restrain the detachment of the other kinds of particles, for example, a release agent, from the surface of toner particles.

Specific examples of such mechanical impact application methods include a method in which a mixture is impacted by a high speed rotation blade and a method in which a mixture is put into a jet air to collide the particles against each other or a collision board. Specific examples of such mechanical impact applicators include ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTRON SYSTEM (manufactured by Kawasaki Heavy Industries, Ltd.), automatic mortars, etc.

The toner of the present invention has a smooth surface. Thus, the toner is excellent in characteristics, for example, transferability and charging property to produce quality images. The toner of the present invention can have furthermore excellent characteristics when the toner is made through an adhesive substrate material obtained by the reaction between a compound having an active hydrogen group and a polymer reactive with an active hydrogen group in an aqueous medium. The toner of the present invention can be suitably used in various kinds of fields of electrophotographic image formation.

The volume average particle diameter of the toner of the present invention is preferably from 3 to 8 μm and more preferably from 4 to 7 μm. When the volume average particle diameter is too small, toner for use in a two-component developing agent may be attached to the surface of a carrier during agitation in a developing unit for an extended period of time, which may lead to the deterioration of charging ability of the carrier. In addition, in the case of a one component developing agent, filming of a toner to a developing roller and attachment of a toner to a part, for example, a blade for regulating the layer thickness of the toner, may occur. When the volume average particle diameter is too large, it may be difficult to obtain quality images with high definition and the particle diameter of a toner may greatly vary when a toner contained in a developing agent is replenished.

The ratio of the volume average particle diameter to the number average particle diameter is preferably from 1.00 to 1.25 and more preferably from 1.05 to 1.25. As a result, in the case of a two-component developing agent, the particle diameter of a toner does not greatly vary when a toner contained in a developing agent is replenished for an extended period of time and stable and good developability can be obtained during agitation in a developing unit for an extended period of time. In the case of a one-component developing agent, the particle diameter of a toner does not greatly vary when a toner contained in a developing agent is replenished for an extended period of time and filming of a toner to a developing roller and attachment of a toner to a part, for example, a blade for regulating the layer thickness of the toner can be restrained. In addition, stable and good developability can be obtained during agitation in a developing unit for an extended period of time. Therefore, quality image can be obtained. When the ratio is too large, it may be difficult to obtain quality images with high definition and the particle diameter of a toner may greatly vary when a toner contained in a developing agent is replenished.

When the ratio (Dv/Dn) of a volume average particle diameter to a number average particle diameter of the toner becomes too large, the size distribution broadens, meaning the number of coarse or fine particles increases, ultimately resulting in an adverse impact on image quality.

When the ratio of the number of toner particles having a circularity of 0.950 or less to the total number of the toner particles is 0.2 to 0.8, the particle size distribution is a particularly preferred distribution in which particles having a suitably irregular form are contained an amount well suited for cleaning by a blade performed on an image bearing member.

The volume average particle diameter and the ratio of the volume average particle diameter to the number average particle diameter can be measured by using the particle size measuring device MULTISIZER (manufactured by Beckman Coulter, Inc.) as follows: Add 0.1 to 5 ml of alkyl benzene sulfuric acid salt, etc., as a dispersing agent in 100 to 150 ml of about 1% by weight NaCl aqueous solution; Add about 2 to 20 mg of a measuring sample thereto; Disperse the electrolyte aqueous solution in which the sample is suspended with a supersonic dispersion device for about 1 to 3 minutes; and measure the volume or the number of the toner with 100 μm aperture for calculation of the volume distribution and the number distribution. The volume average particle diameter and the number particle diameter of the toner can be obtained from the volume distribution and the number distribution.

The average circularity of the toner of the present invention is preferably from 0.94 to 0.97 and more preferably from 0.945 to 0.965. The circularity is obtained by the following relationship: (the circumferential length of the circle having the area equal to a projected toner area/the circumferential length of the projected toner area). It is preferred to have the content of the particles having an excessively small circularity (for example, less than 0.94) not greater than 15%. An average circularity that is too small may make difficult obtaining quality image with sufficient transferability and without dust. An average circularity that is too small may cause insufficient cleaning for an image bearing member or a transfer belt in an image forming apparatus taking a blade cleaning system, which leads to fouling on an image. For example, in the case of an image, for example, a photograph image, having a large imaging area, background fouling may occur when toner is accumulated on an image bearing member due to an untransferred image caused by paper jamming, etc., and a charging roller, which directly contacts with the image bearing member, may be contaminated, which makes it difficult to perform the original function of charging.

An optical detection method can be used for measuring the average circularity of a toner in which particle images are optically detected by a charge coupled device (CCD) camera while a suspension containing the particles passes through an imaging detective portion having a plate form. The average circularity can be measured by, for example, a flow particle image analyzer (FPIA-2000, manufactured by Sysmex Corporation).

The form factor SF-1 of the toner of the present invention is preferably from 115 to 130. SF1 is defined by the following relationship: $SF\text{-}1=(L^2/A)\times(100\Pi/4)$.

L represents the average of the maximum diameter of a toner particle obtained and A represents the average of projected area of a toner particle. When the SF-1 is 100, the toner particle is a true sphere. As SF-1 increases, the toner form differs away from a true sphere form. L and A can be obtained as follows: Magnify particle images with a power of 300 using a scanning electron microscope (FE-SEM: S-800, manufactured by Hitachi Ltd.); Sample 100 toner particle images; and analyze the images with an image analyzer (for example, LUZEX AP, manufactured by Nireco Corp.) through an interface.

The specific surface area of the toner of the present invention is preferably from 0.5 to 3.0 $m^2/g$ and more preferably from 0.5 to 2.5 $m^2/g$. A specific surface area that is too small may have an adverse impact on the effect of external additives, which leads to deterioration of fluidity and charging property of a toner. A specific surface area that is too small may cause deterioration of transferability. The specific surface area can be measured by BET method. To be specific, nitrogen gas is adhered to the surface of a sample using a surface area and porosimetry analyzer (TriStar 3000, manufactured by Shimadzu Corporation).

The penetration level of the toner of the present invention is preferably not less than 15 mm and more preferably from 20 to 30 mm. A penetration level that is too short may cause deterioration of the heat resistance preservation property. The penetration level can be measured by the penetration level test according to JIS K2235-1991.

Specific procedure is as follows: Fill a glass vessel having a volume of 50 ml with toner; let the container stand in a constant-temperature bath at 50° C. for 20 hours; Cool the toner down to room temperature; and conduct the penetration level test. A large penetration level means an excellent heat resistance preservation property.

The toner of the present invention preferably has a low temperature for the lower limit fixing temperature and a high temperature for the limit temperature below which offset does not occur in terms of having a good combination of the low temperature fixing property and the anti-off set property. The lower limit fixing temperature is preferably less than 140° C. and the limit temperature below which offset does not occur is not lower than 200° C. The lower limit fixing temperature is determined as the fixing temperature below which the remaining ratio of the image density is less than 70% after the fixing image is rubbed by a pad for a photocopying test using an image forming apparatus. The limit temperature below which offset does not occur can be obtained by measuring temperatures by using an image forming apparatus adjusted in such a manner that images are developed with a predetermined amount of toner.

The thermal characteristics of a toner are referred to as flow tester characteristics and evaluated by the softening temperature, the flowing start temperature and the 1/2 method softening point. These thermal characteristics can be measured by a suitably selected method with an elevated flow tester CFT 500 type (manufactured by Shimadzu Corporation).

The softening point of the toner of the present invention is preferably not lower than 30° C. and more preferably from 50 to 90° C. A softening point that is too low may cause deterioration of the heat resistance preservation property.

The flowing start temperature of the toner of the invention is preferably not lower than 60° C. and more preferably from 80 to 120° C. A flowing start temperature that is too low may decrease at least one of the heat resistance preservation property and the anti-offset property.

The 1/2 method softening point of the toner of the present invention is preferably not lower than 90° C. and more preferably from 100 to 170° C. A 1/2 method softening point that is too low may cause deterioration of the anti-offset property.

The glass transition temperature of the toner of the present invention is preferably form 40 to 70° C. and more preferably from 45 to 65° C. A glass transition temperature that is too low may cause deterioration of the heat resistance preservation property of a toner. A glass transition temperature that is too high may result in insufficiency of the low temperature fixing property. The glass transition temperature can be measured by, for example, a differential scanning calorimetry (DSC) (DSC-60, manufactured by Shimadzu Corporation).

The density of images formed by the toner of the present invention is preferably not less than 1.40, more preferably not less than 1.45 and further preferably nor less than 1.50. An excessively low image density may result in low image density, resulting in low quality images. The image density can be obtained as follows: Form solid images on photocopying paper type 6200 (manufacture by Ricoh Co., Ltd) using a tandem color image forming apparatus (imagio Neo 450, manufacture by Ricoh, Co., Ltd) such that the content of the attachment of a developing agent thereon is from 0.9 to 1.1 $mg/cm^2$ with the surface temperature of the fixing roller from 158 to 162° C.; and measure the image density of 5 points randomly selected from the obtained solid image by a spectrometer (938 spectrodensitometer, manufactured by X-rite Co., Ltd.) for calculating the average thereof.

The color of the toner of the present invention can be suitably selected and at least one of each group of black toner, cyan toner, magenta toner and yellow toner can be used. Each color can be obtained by suitably selecting a colorant.

A developing agent that contains the toner of the present invention and optionally a carrier is preferably used to improve transferability, charging property, etc., to stably form quality images.

The developing agent can be a one-component developing agent and a two-component developing agent, which is preferred in terms of life expectancy when used for a high speed printer which can deal with the improvement of information processing speed of late.

When such a developing agent is used as a one-component developing agent and replenished, the variance of the particle diameter of the toner is small and filming of the toner on a developing roller and fusion bonding of the toner onto a member, for example, a blade for regulating the thickness of the toner layer, hardly occur. Therefore, good and stable developability is obtained so that quality images can be produced when the developing unit is used (i.e., stirring) for an extended period of time. When such a developing agent is used as a two-component developing agent and replenished in a long period of time, the variance in the particle diameter of the toner in the developing agent is small and the developability of the toner is good and stable for stirring repeated performed in a developing unit over a long period of time.

Carriers can be suitably selected and it is preferred for carriers to have a core material and a resin layer covering the core material.

The materials for the core materials can be selected from known materials and manganese-strontium based material or manganese-magnesium based material from 50 to 90 emu/g. To secure the density of images, high magnetized materials, for example, iron powder not less than 100 emu/g and magnetite from 75 to 120 emu/g, can be preferably used. To relax the impact of a developing agent in a filament state to an image bearing member and to be advantageous for quality images, low magnetized materials, for example, copper-zinc based material from 30 to 80 emu/g, can be preferably used. These can be used alone or in combination.

The volume average particle diameter of the core material is preferably from 10 to 150 μm and more preferably from 40 to 100 μm. When the volume average particle diameter is too small, the ratio of fine particles in carriers increases and the magnetization per particle decreases, which may lead to scattering of carriers. When the volume average particle diameter is too large, the specific surface area decreases, which may cause scattering of toner. In the case of a full color image having a large solid portion, the representation of the solid portion may deteriorate.

The materials for the resin layer can be suitably selected among known resins. Specific examples thereof include amino resins, polyvinyl resins, polystyrene resins, polyhalogenated olefin, polyester resins, polycarbonate resins, polyethylene, polyfluoro vinyl, polyfluoro vinylidene, polytrifluoroethylene, polyhexafluoropropylene, a copolymer of polyfluoro vinylidene and an acryl monomer, a copolymer of polyfluoro vinyl and polyfluoro vinylidene, fluoroterpolymers, for example, a copolymer of tetrafluoroethylene, fluorovinylidene and other monomers including no fluorine atom, and silicone resins. These can be used alone or in combination.

Specific examples of amino resins include urea-formaldehyde resins, melamine resins, benzoguanamine resins, urea resins, polyamide resins and epoxy resins. Specific examples of polyvinyl resins include acrylic resins, polymethylmethacrylate resins, polyacrylonitirile resins, polyvinyl acetate resins, polyvinyl alcohol resins and polyvinyl butyral resins. Specific examples of polystyrene resins include polystyrene resins and styrene-acrylic copolymers. Specific examples of polyhalogenated olefine resins include polyvinyl chloride resins. Specific examples of polyester resins include polyethyleneterephthalate resins and polybutyleneterephthalate resins.

If desired, electroconductive powder can be contained in the coating resin. Specific preferred examples of such electroconductive powder include metal powder, carbon black, titanium oxides, tin oxides, and zinc oxides. The average particle diameter of such electroconductive powder is preferably not greater than 1 μm. When the particle diameter is too large, it may become difficult to control the resistance thereof.

The resin layer can be formed by dissolving silicone resins, etc., in a solvent to prepare a liquid of application and applying the liquid of application to the surface of a core material by a known application method followed by drying and baking. Specific examples of the application method include a dip coating method, a spraying method, and brush coating method. The solvent can be suitably selected and toluene, xylene, methylethylketone, methylisobutylketone and butyl cellosolve acetate. The baking can be performed by an external heating system or an internal heating system. Methods using a fixing electric furnace, a fluid type electric furnace, a rotary type electric furnace, a burner furnace or microwave can be used.

The content of the resin in a carrier is preferably from 0.01 to 5% by weight. A content that is too small may cause no uniform formation of a resin layer on the surface of a core material. A content that is too large may cause fusion attachment of carrier particles to each other because the layer thickness is high, which causes deterioration of uniformity among carrier particles.

The toner of the present invention or a developing agent containing the toner can be contained in a toner container. The container of the toner container can be selected from known containers. A container with a cap can be preferably used.

The size, form, structure and material of the container can be suitably selected.

The form is preferably a cylindrical form having a spirally formed concavity or convexity towards inside part or the entire of which optionally has an accordion function for conveying toner and/or easy recycling use. Such a container can transfer toner contained therein to the discharging mouth by rotation.

The material of such a container is preferably a material having a good dimension accuracy. Polyester resins, polyethylene resins, polypropylene resins, polystyrene resins, polyvinyl chloride resins, polyacrylate resins, polycarbonate resins, ABS resins and polyacetal resins can be used.

The toner container is easy to preserve, transfer and handle and can be detachably attached to a process cartridge or an image forming apparatus to replenish toner.

A process cartridge can include an image bearing member, a developing device which contains the toner of the present invention or a developing agent containing the toner and an optional other devices.

Thus, visualized images can be developed by developing latent electrostatic images on an image bearing member with the developing agent.

The developing device preferably has a container containing the toner of the present invention or a developing agent containing the toner of the present invention and a developing agent bearing member for bearing and transferring the toner or the developing agent.

Such a process cartridge can be detachably attached to the main body of an image forming apparatus.

Quality images can be formed by a method of forming images using the toner of the present invention or a developing agent containing the toner.

A method of forming images uses the toner or the developing agent for image formation so that quality images can be obtained.

The method of forming images preferably includes; a latent electrostatic image formation process, a developing image process, a transfer process and fixing process with optional processes, for example, a discharging process, a cleaning process, a recycling process and a controlling process.

An image forming apparatus can be structured by including an image bearing member, a latent electrostatic image formation device, a developing device containing the toner of the present invention or a developing agent containing the toner, a transfer device and a fixing device with optional devices, for example, a discharging device, a cleaning device, a recycling device and a controlling device.

The latent electrostatic image formation process is a process for forming latent electrostatic images on an image forming apparatus. The size, form, structure, material, etc., of an image bearing member can be suitably selected. Inorganic materials, for example, amorphous silicon and selenium, and organic materials, for example, polysilane and phthalopolymethine, can be used and amorphous silicone is preferred considering life expectancy. Drum forms are preferred. Latent electrostatic images can be formed by uniformly charging the surface of an image bearing member followed by irradiation with a latent electrostatic image formation device. The latent electrostatic image formation device preferably includes a charging device for uniformly charging the surface of an image bearing member and an irradiating device for irradiating the surface of the image bearing member.

The charging process can be performed by applying a voltage to the surface of an image bearing member with a charging device. The charging device can be suitably selected. There can be used known contact type charging devices having, for example, a conductive or semi-conductive roll, brush, film and/or a rubber blade, and known non-contact type charging devices using corona discharging, for example, a corotron or scorotron.

Irradiation can be performed by irradiating the surface of an image baring member with an irradiating device. Irradiating devices can be suitably selected and various kinds of photocopying optical systems, rod lens array systems, laser optical systems, liquid crystal shutter optical systems can be used. It is also possible to irradiate an image bearing member from the rear thereof, i.e., rear optical irradiation system.

The developing process is a process for forming visualized images by developing latent electrostatic images with the toner of the present invention or the developing agent containing the toner. Visualized images can be formed with a developing device. Such a developing device can be suitably selected among known devices and preferably has a developing unit accommodating the toner of the present invention or the developing agent containing the toner and providing the toner or the developing agent to a latent electrostatic image in a contact or non-contact manner. A developing unit having the toner of the present invention is preferably used. There is no specific preference to the development system (i.e., dry or wet). Single-color developing units and multiple color developing units can be used. Specific examples thereof include a stirring device for charging the toner or the developing agent by frictionally stirring and a developing unit having a rotationable magnet roller. The developing agent accommodated in a developing unit is the developing agent, which can be a one-component or two-component developing agent.

In a developing unit containing a two-component developing agent, toner and carrier are mixed and stirred so that the toner is frictionally charged and held on the surface of a rotating magnet roller like a filament to form a magnet brush. The magnet roller is disposed in the vicinity of an image bearing member. Therefore, part of toner forming the magnet brush held on the surface of the magnet roller is transferred to the surface of the image bearing member by electric force. As a result, a latent electrostatic image is developed by toner and an image visualized by the toner is formed on the surface of the image bearing member.

The transfer process is a process for transferring visualized images to a recording medium and it is preferred to use an intermediate transfer body to which a visualized image is primarily transferred and secondarily transfer the visualized image to a recording medium. The toner for use at this point is usually multi-colored and a full color toner is preferred. Therefore, it is more preferred to have a primary transfer process for forming an overlapped transfer image by transferring a visualized toner to an intermediate transfer body and a second transfer process for transferring the overlapped transfer image to a recording medium.

Transfer is performed by charging an image bearing member using a transfer device. The transfer device is preferred to have a primary transfer device for forming an overlapped transfer image by transferring a visualized toner to an intermediate transfer body and a second transfer device for transferring the overlapped transfer image to a recording medium. An intermediate transfer body can be suitably selected from known transfer bodies and a transfer belt can be used.

The transfer device preferably has a transfer unit for peel-charging a visualized image formed on an image bearing member to a recording medium side. A single transfer device system or a plural transfer device system can be used. Specific examples of such a transfer unit include a corona transfer unit by corona charging, a transfer belt, a transfer roller, a pressure transfer roller and an adhesive transfer unit. A recording medium can be suitably selected among known recording media and recording paper can be used.

The fixing process is a process for fixing a visualized image transferred onto a recording medium with a fixing device. Fixing can be performed each time each color toner is transferred to a recording medium or after each color toner is overlapped. A fixing device can be suitably selected and known heating and pressure devices can be used. Specific examples thereof include a combination of a heat roller and a pressing roller or a combination of a heat roller, a pressing roller and an endless belt. The fixing temperature of such a heating and pressure device is preferably from 80 to 200° C. In addition, such a fixing device can be replaced with or in combination with a known optical fixing device.

The discharging process is a process of discharging an image bearing member by applying a discharging bias thereto and can be performed by a discharging device. A discharging device can be selected among known discharging devices and a discharging lamp can be used.

The cleaning process is a process for removing toner remaining on an image bearing member and can be performed by a cleaning device. A cleaning device can be selected among known cleaning devices and there can be used a magnetic brush cleaner, an electrostatic brush cleaner, a magnetic roller cleaner, a blade cleaner, a brush cleaner and a web cleaner.

The recycling process is a process for recycling toner removed in the cleaning process by a recycling device. A recycling device can be selected among known transfer devices, etc.

The controlling process is a process for controlling each process and can be performed by a controlling device. A controlling device can be selected from devices, for example, a sequencer and a computer.

FIG. 1 is a diagram illustrating an example of the image forming apparatus for use in the present invention. An image forming apparatus 100A includes a photoreceptor 10 having a drum form as an image bearing member, a charging roller 20 as a charging device, an irradiating device 30, a developing device 40, an intermediate transfer body 50, a cleaning device 60 and a discharging lamp 70 as a discharging device.

The intermediate transfer body 50 is an endless belt and suspended over three rollers 51 so that the endless belt 50 can move in the direction indicated by the arrow. Part of the three rollers 51 can be a transfer bias roller which applies a transfer bias (primary transfer bias) to the intermediate transfer body 50. In the vicinity of the intermediate transfer body 50 is arranged a cleaning device 90 having a cleaning blade. Also a transfer roller 80 functioning as a transfer device which can apply a transfer bias to secondarily transfer a visualized toner image to a recording paper 95 as a recording medium is disposed opposing the intermediate transfer body 50. Around the intermediate transfer body 50, a coroner charger 58 for imparting charges to a toner image on the intermediate transfer body 50 is disposed between the contact portion of the image bearing member 10 and the intermediate transfer body 50 and the contact portion of the intermediate transfer body 50 and a transfer paper 95 in the rotation direction of the intermediate transfer body 50.

The developing device 40 includes a developing belt 41 as a developing agent bearing member, and a black developing unit 45K, a yellow developing unit 45Y, a magenta developing unit 45M and a cyan developing unit 45C arranged around the developing belt 41.

The black developing unit 45K includes a developing agent accommodation portion 42K, a developing agent supplying roller 43K and a developing roller 44K. The yellow developing unit 45Y includes a developing agent accommodation portion 42Y, a developing agent supplying roller 43Y and a developing roller 44Y. The magenta developing unit 45M includes a developing agent accommodation portion 42M, a developing agent supplying roller 43M and a developing roller 44M. The cyan developing unit 45C includes a developing agent accommodation portion 42C, a developing agent supplying roller 43C and a developing roller 44K. The developing 41 is an endless belt and suspended by a plural belt rollers so that the developing belt 41 can move in the direction indicated by the arrow and part thereof is made in contact with the photoreceptor 10

In the image forming apparatus 100A, the charging roller 20 uniformly charges the photoreceptor 10, and the irradiating device 30 irradiates the photoreceptor 10 so that a latent electrostatic image is formed. The developing device 40 supplies a developing agent to the latent electrostatic image formed on the photoreceptor 10 to develop and form a toner image. The toner image is primarily transferred to the intermediate body 50 by the voltage applied by the rollers 51 and secondarily transferred to a recording medium 95. Thus, the transferred image is formed on the recording paper 95. The toner remaining on the photoreceptor 10 is removed by the cleaning device 60 having a cleaning blade and the charges on the photoreceptor 10 is removed by the discharging lamp 70.

Figure 2:
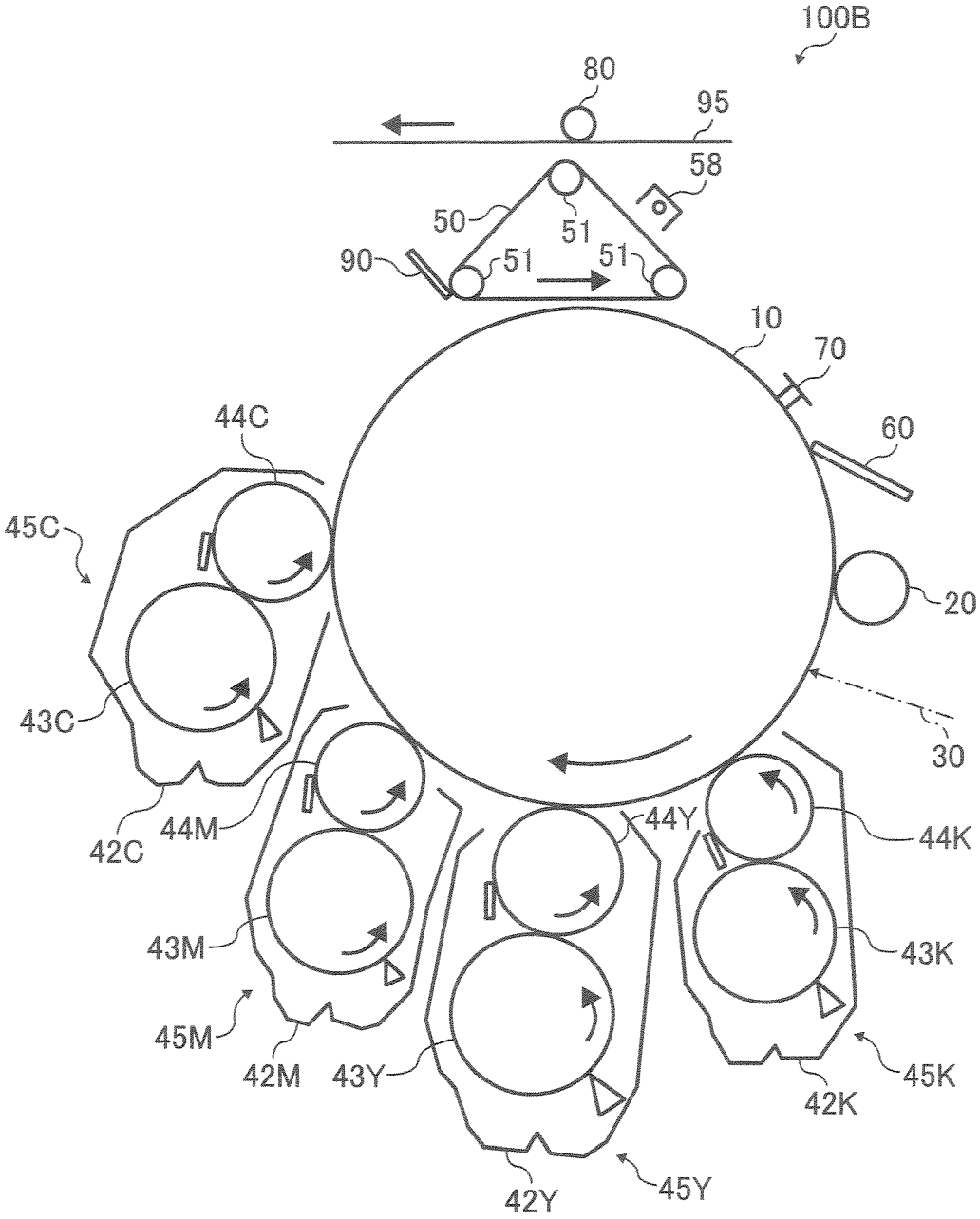
FIG. 2 is another schematic diagram illustrating an example of an image forming apparatus using the toner of the present invention.

FIG. 2 is a diagram illustrating another example of the image forming apparatus 100B for use in the present invention. The image forming apparatus 100B has the same structure and function as those of the image forming apparatus 100A except that the developing belt 41 is not contained and a black developing unit 45K, a yellow developing unit 45Y, a magenta developing unit 45M and a cyan developing unit 45C are disposed around and opposing the photoreceptor 10. In FIG. 2, the same numeral references are assigned as in FIG. 1 when these are the same.

Figure 3:
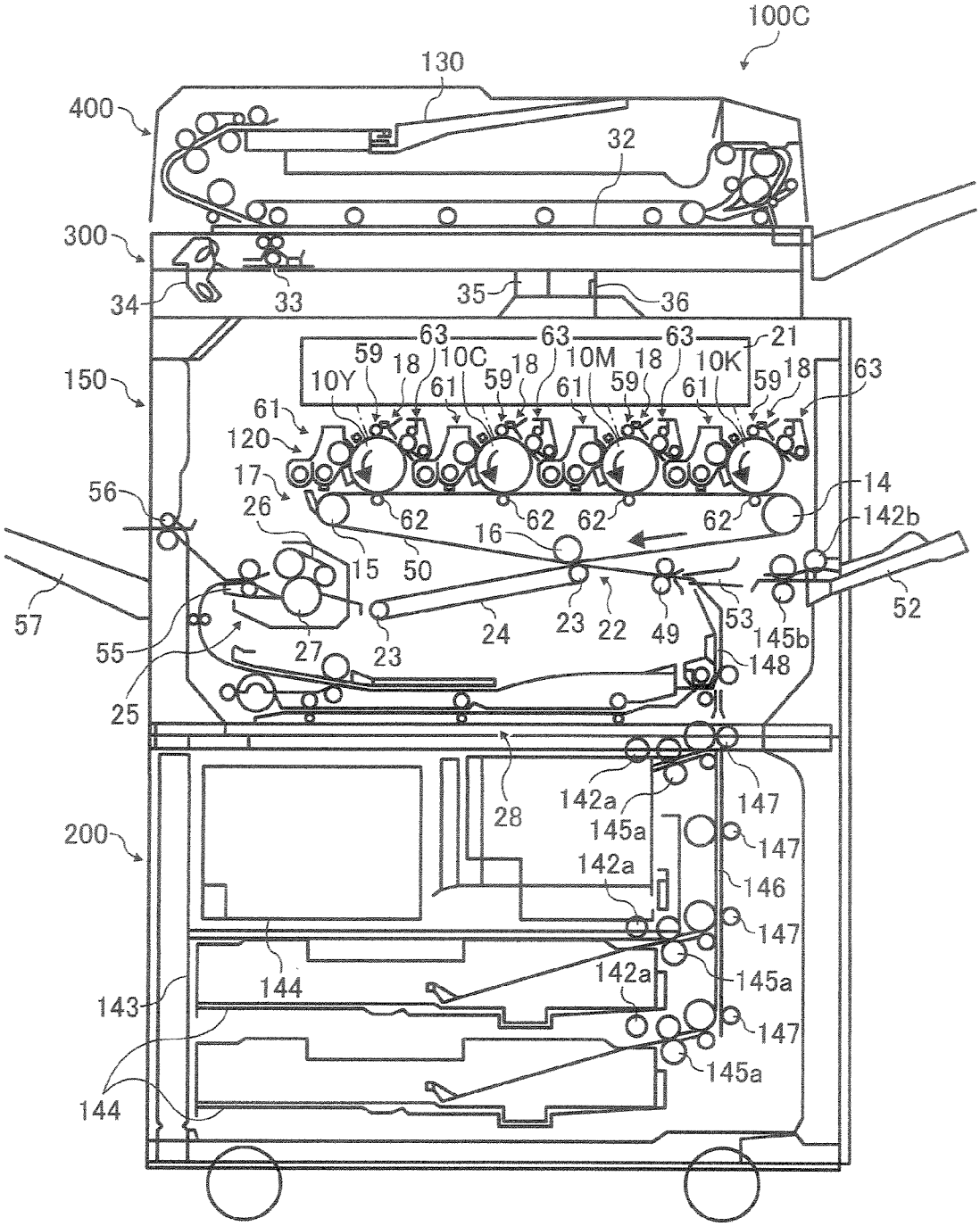
FIG. 3 is another schematic diagram illustrating an example of an image forming apparatus using the toner of the present invention.

FIG. 3 is a diagram illustrating another example of the image forming apparatus 100C for use in the present invention. The image forming apparatus 100C includes a main body 150 of photocopying apparatus, a paper feeding table 200, a scanner 300 and an automatic document feeding device 400. The intermediate transfer body 50 having an endless belt form is provided in the center of the main body 150. The intermediate transfer body 50 is suspended over suspending rollers 14, 15 and 16 so that the intermediate transfer body 50 can move clockwise in FIG. 3. An intermediate transfer body cleaning device 17 is arranged close to the suspending roller 15 to remove toner remaining on the intermediate transfer body 50. A tandem type developing unit 120 is arranged for the intermediate transfer body 50 suspended over the suspending roller 14 and 15 and has image formation devices 18 of 4 colors of yellow, cyan, magenta and black which are arranged opposing the intermediate transfer body 50 along the transfer direction thereof. In the vicinity of the tandem type developing unit 120 is arranged an irradiating device 21. A secondary transfer device 22 is arranged to the intermediate transfer body 50 on the opposite side on which the tandem type developing unit 120 is arranged. The secondary transfer device 22 has a secondary transfer belt 24 having an endless belt form suspended over a pair of rollers 23 and a recording medium transferred on the secondary transfer belt 24 can contact the intermediate transfer body 50. A fixing device 25 is arranged in the vicinity of the secondary transfer device 24. The fixing device 25 has a fixing belt 26 having an endless form and a pressure roller 27 arranged applying a pressure to the fixing belt 26.

In the image forming apparatus 100C, a sheet reversing device 28 for reversing a transfer sheet is disposed near the secondary transfer device 22 and the fixing device 25. Thus, images can be formed on both sides of a recording medium.

Next, full color image formation using the tandem type developing unit 120 is described. An original (document) is set on a document plate 130 of the automatic document feeding device 400 or on a contact glass 32 of the scanner 300 automatic document feeding device 400. When a start switch (not shown) is pressed, the original set on the automatic document feeding device 400 is transferred to the contact glass 32 and the scanner 300 starts scanning operating by driving a first scanning body 33 and a second scanning body 34. In the case of the original directly set on the contact glass 32, the scanner 300 starts scanning the original immediately after the start switch is pressed. The light from the first scanning body 33 is reflected at the original and the reflected light is reflected at the mirror of the second scanning body 34 and received by a reading sensor 36 via an image focus lens 35. Consequently, the original is read and each color image information of black, yellow, magenta and cyan is stored. Each image information is sent to each image formation device 18 in the tandem type developing unit 120 and each color toner image is formed.

The black color toner image on a photoreceptor 10K, the yellow color toner image on a photoreceptor 10Y, the magenta color toner image on a photoreceptor 10M and the cyan color toner image on a photoreceptor 10C are sequentially overlapped on the intermediate transfer body 50. Each color toner image is overlapped on the intermediate transfer body 50 to form a synthesized color image (color transfer image).

Figure 4:
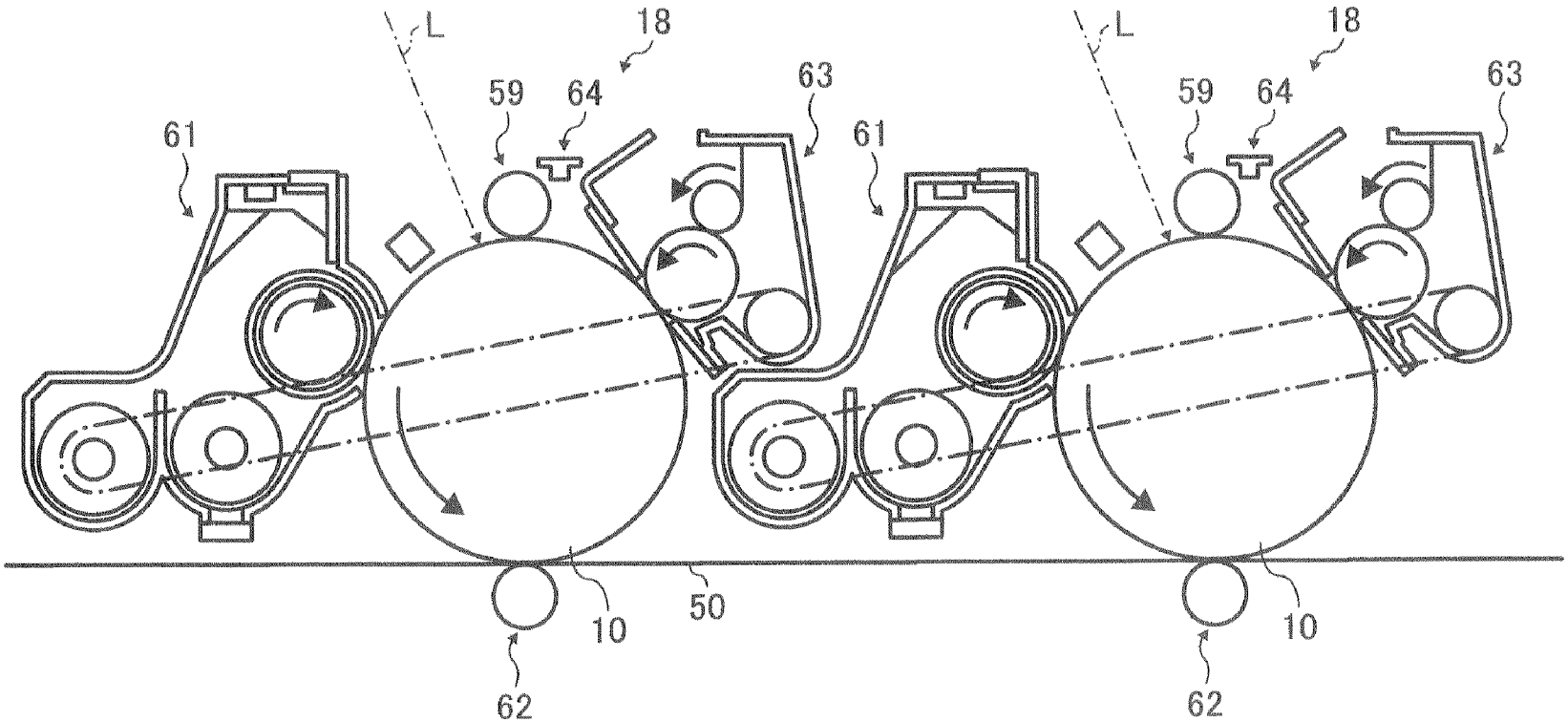
FIG. 4 is a schematic diagram illustrating a part of the image forming apparatus illustrated in FIG. 3.

As illustrated in FIG. 4, each color image formation device 18 in the tandem type development unit 120 has the following: the photoreceptor 10(K,Y,C,M); the charging device 59(K,Y,C,M) for uniformly charging the photoreceptor 10(K,Y,C,M); the irradiating device 21(K,Y,C,M) for forming each latent electrostatic image on the photoreceptor 10(K,Y,C,M); the developing unit 61(K,Y,C,M) for developing each latent electrostatic image to form each color toner image on the photoreceptor 10(K,Y,C,M); a transfer charging device 62(K,Y,C,M) for transferring each color toner image on the intermediate transfer body 50; a photoreceptor cleaning device 63(K,Y,C,M); and a discharging device (K,Y,C,M).

At the paper feeding table 200, one of paper feeding rollers 142*a* is selectively rotated to transfer recording media from one of multi-stack paper feeding cassettes 144 provided in a paper bank 143. A separation roller 145*a* separates the recording media one by one and sent into the paper feeding path 146. The recording medium is guided by a transfer roller 147 to a paper feeding path 148 in the main body 150 of photocopying apparatus and stops at registration rollers 49. Alternatively, recording media on a manually handling tray 52 are transferred by rotating a paper feeding roller 142*b*. A separation roller 145*b* separates the recording media one by one to sent a manually handling paper feeding path 53 and the recording medium stops at the registration rollers 49. Registration rollers are generally grounded for use but can be used in a state in which a bias is applied to remove paper dust of recording media.

The registration rollers 49 are rotated in a synchronization manner to the timing of a color transfer image formed on the intermediate transfer body 50 to send out the recording medium to between the intermediate transfer body 50 and the secondarily transfer device 22. Thus, a color transfer image is formed on the recording medium. The toner remaining on the intermediate transfer body 50 after transfer is removed by the intermediate transfer body cleaning device 17.

The recording medium on which the color transfer image is formed is transferred to the fixing device 25 by the secondarily transfer device 22 and fixed on the recording media upon application of heat and pressure. Thereafter, the recording medium is switched by a switching claw, discharged by a discharging roller 56 and stacked on a discharged recording medium tray 57. Alternatively, the recording medium is switched by a switching claw 55, reversed by the recording medium reversing device 28 and guided to the transfer position again. After an image is formed on the reverse side of the recording medium, the recording medium is discharged from the discharging roller 56 and stacked on the discharged recording medium tray 57.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

In a preferred embodiment herein, the toner according to the invention is prepared by a method comprising dissolving or dispersing the colorant, the binder resin, a precursor of the binder resin, and a compound for conducting an elongation reaction or a cross-linking reaction with the precursor, the laminar inorganic mineral and a release agent in an organic solvent, to prepare a toner constituent mixture liquid; dispersing or emulsifying the toner constituent mixture liquid in an aqueous medium while subjecting the precursor to the crosslinking reaction or the elongation reaction with the compound, to prepare a toner dispersion; and removing the organic solvent from the toner dispersion.

Regardless of how the toner is made, the following are preferred embodiments thereof:

a ratio (Dv/Dn) of a volume average particle diameter (DV) of the toner to a number average particle diameter (Dn) of the toner is from 1.00 to 1.30 and particles of the toner having a circularity not greater than 0.950 occupies 20 to 80% of all the toner particles;

a ratio of particles of the toner having a particle diameter not greater than 2 μm is from 1 to 20% by number a content of polyester resin in the binder resin ranges from 50 to 100% by weight;

a weight average molecular weight of tetrahydrofuran soluble portion of the polyester resin ranges from 1,000 to 30,000;

the resin has a polyester skeleton having an acid value of from 1.0 to 50.0 mgKOH/g;

the resin has a polyester skeleton having a glass transition of from 35 to 65° C.;

the precursor of the binder resin has a portion reactive with a compound having an active hydrogen group and a polymer of the precursor has a weight average molecular weight of from 3,000 to 20,000.

EXAMPLES

Example 1

The following components are contained in a reaction container equipped with a condenser, stirrer and a nitrogen introducing tube to conduct a reaction at 230° C. for 8 hours followed by another reaction with a reduced pressure of 10 to 15 mmHg for 5 hours:

| | |
|---|---|
| Adduct of bisphenol A with 2 mol of ethylene oxide | 229 parts |
| Bisphenol A with 3 mole of propylene oxide | 529 parts |
| Terephthalic acid | 208 parts |
| Adipic acid | 46 parts |
| Dibutyl tin oxide | 2 parts |

Forty four (44) parts of trimellitic anhydride is added in the container to conduct a reaction at 180° C. under normal pressure for 2 hours and obtain Non-modified polyester resin 1.

Non-modified polyester resin 1 has a number average molecular weight of 2,500, a weight average molecular weight of 6,700, a glass transition temperature of 43° C. and an acid value of 25 mgKOH/g.

One thousand two hundred (1200) parts of water, 540 parts of carbon black (Printex 35, from Degussa AG) which has a dibutyl phthalate (DBP) oil absorption of 42 ml/100 mg and has a PH of 9.5, and 1,200 parts of a polyester resin are added and mixed in a HENSCHELMIXER® (manufactured by Mitsui Mining Company, Limited). This mixture is kneaded for 30 minutes at 150° C. using a two-roll mill followed by rolling and cooling. Thereafter, the kneaded mixture is pulverized by a pulverizer (manufactured by Hosokawa Micron Co., Ltd.) to obtain Master batch 1.

The following is placed and mixed in a reaction container equipped with a stirrer and a thermometer:

| | |
|---|---|
| Non-modified polyester resin 1 | 378 parts |
| Carnauba wax | 110 parts |
| Ethyl acetate | 947 parts |

The mixture is agitated, heated to 80° C., and kept at 80° C. for 5 hours and then cooled down to 30° C. in 1 hour. Then, 500 parts of Master batch 1 and 500 parts of ethyl acetate are added to the reaction container and mixed for 1 hour to obtain a liquid material.

Then, 1,324 parts of the obtained liquid material are transferred to a reaction container and dispersed using a bead mill (ULTRAVISCOMILL from AIMEX) under the following conditions to disperse pigment red and carnauba wax to obtain a wax liquid dispersion:

Liquid feeding speed: 1 kg/hr,
Disc rotation speed: 6 m/sec,
Diameter of zirconia beads: 0.5 mm,
Filling factor: 80% by volume, and
Repeat number of dispersion treatment: 3 times.

Next, 1,324 parts of Non-modified polyester resin 1 of 65% by weight of ethyl acetic acid solution are added to the wax liquid dispersion. To 200 parts of a liquid dispersion obtained after 1 pass of ULTRA VISCOMILL under the same condition mentioned above, 2.0 parts of CLAYTONE APA (manufactured by Southern Clay Product Co., Ltd.) are added as a charge controlling agent and the mixture is stirred for 60 minutes by using T.K. HOMODISPER (manufactured by Tokushu Kika Kogyo Co., Ltd. at 7,000 rpm to obtain a liquid dispersion of a toner material.

The following components are contained in a container equipped with a condenser, a stirrer and a nitrogen introducing tube to conduct a reaction at 230° C. at normal pressure for 8 hours followed by another reaction for 5 hours with a reduced pressure of 10 to 15 mmHg to obtain an intermediate polyester resin:

| | |
|---|---|
| Adduct of bisphenol A with 2 mole of ethylene oxide | 682 parts |
| Adduct of bisphenol A with 2 mole of propylene oxide | 81 parts |
| Terephthalic acid | 283 parts |
| Trimellitic anhydrate | 22 parts |
| Dibutyl tin oxide | 2 parts |

The obtained intermediate polyester resin has a number average molecular weight of 2,100, a weight average molecular weight of 9,500, a glass transition temperature of 55° C., an acid value of 0.5 mgKOH/g and a hydroxyl value of 51 mgKOH/g.

Next, the following components are contained in a container equipped with a condenser, a stirrer and a nitrogen introducing tube to conduct a reaction at 100° C. for 5 hours to obtain a prepolymer:

| | |
|---|---|
| Intermediate polyester 4 | 410 parts |
| Isophorone diisocyanate | 89 parts |
| Ethyl acetate | 500 parts |

The obtained prepolymer has an isolated isocyanate weight % of 1.53%.

The following is placed and mixed in a reaction container equipped with a stirrer and a thermometer for a reaction for 5 hours to synthesize a ketimine compound:

| | |
|---|---|
| Isophorone diamine | 170 parts |
| Methyl ethyl ketone | 75 parts |

The amine value of the obtained ketimine compound is 418 mgKOH/g.

Then, 749 parts of the liquid dispersion of toner material, 115 parts of the prepolymer and 2.9 parts of the ketimine compound are placed in the reaction container and the mixture is mixed for 1 minutes using TK HOMOMIXER (manufactured by Tokushu Kika Kogyo Co., Ltd.) at 5,000 rpm to obtain an oil phase liquid mixture.

The following components are placed in a container equipped with a stirrer and a thermometer and agitated for 15 minutes at a revolution of 400 rpm to obtain an emulsion.

| | |
|---|---|
| Water | 683 parts |
| Sodium salt of sulfate of an adduct of methacrylic acid with ethyleneoxide (Reactive emulsifying agent, EREMINOR RS-30 from Sanyo Chemical Industries Ltd.) | 11 parts |
| Styrene | 83 parts |
| Methacrylic acid | 83 parts |
| Butylacrylate | 110 parts |
| Ammonium persulfate | 1 part |

Thereafter, the emulsion is heated to 75° C. to conduct a reaction for 5 hours. Then, 30 parts of a 1 weight % aqueous solution of ammonium persulfate are added to the emulsion and the mixture is further aged for 5 hours at 75° C. to obtain resin particulate liquid dispersion. The volume average particle diameter of the obtained resin particulate liquid dispersion is 105 nm when measured by a particle diameter distribution measuring device microtrack super particulate size distribution (UPA-EX150, manufactured by Nikkiso Co., Ltd.). Part of the resin portion is isolated by drying a part of resin particulate liquid dispersion. The isolated resin has a glass transition temperature (Tg) of 59° C. and a weight average molecular weight of 150,000.

Eighty three (83) parts of the resin particulate liquid dispersion are mixed and stirred with the following components to obtain an aqueous medium:

| | |
|---|---|
| Water | 990 parts |
| 48.5% aqueous solution of sodium dodecyldiphenyletherdisulfonate (EREMINOR MON-7 from Sanyo Chemical Industries, Ltd.) | 37 parts |
| 1% by weight aqueous solution of polymer dispersing agent carboxytnethyl cellulose sodium (CELLOGEN BS-H-3, manufactured by Dai-ichi Kogyo Seiyaku Kogyo Co., Ltd.) | |
| Ethyl acetate | 90 parts |

Next, 867 parts of the oil phase liquid mixture is added to and mixed with 1,200 parts of the aqueous medium using a TK HOMOMIXER for 20 minutes at 13,000 rpm to prepare a liquid dispersion (emulsified slurry).

The emulsion slurry is placed in a reaction container equipped with a stirrer and a thermometer to remove the solvents at 30° C. for 8 hours. Thereafter, the resultant is aged at 45° C. for 4 hours to obtain a dispersion slurry, which has a volume average particle diameter of 5.1 μm and a number average particle diameter of 4.9 μm (measured by Multisizer III, manufactured by Beckman Coulter Inc.). One hundred (100) parts of the dispersion slurry are filtered under a reduced pressure. Thereafter, 100 parts of deionized water are added to the thus prepared filtered cake and the resultant is mixed for 10 minutes at a rotation of 12,000 rpm by a TK HOMOMIXER and then filtered. Next, 10% by weight phosphoric acid is added to the resultant filtered cake to adjust pH to be 3.7 followed by mixing and for 10 minutes at a rotation of 12,000 rpm by a TK HOMOMIXER and then filtered.

Furthermore, 300 parts of deionized water are added to the obtained filtered cake and the resultant is mixed for 10 minutes at a rotation of 12,000 rpm by a TK HOMOMIXER and then filtered. This washing is repeated twice to obtain a final filtered cake. The final filtered cake is dried at 45° C. for 48 hours using a circulating drier. The obtained dried cake is filtered using a screen having a mesh of 75 μm to obtain Mother toner particle 1.

As external additives, 1.0 part of a hydrophobic silica and 0.5 parts of hydrophobic titanium oxide are added to 100 parts of Mother toner particle 1 followed by mixing with a HENSCHEL MIXER (manufactured by Mitsui Mining Company, Limited) to manufacture Toner 1.

Example 2

Mother toner particle 2 and Toner 2 are prepared in the same manner as in Example 1 except that the addition amount of CLAYTONE APA used as a charge controlling agent is changed from 2.0 parts to 1.0 part.

Example 3

Mother toner particle 3 and Toner 3 are prepared in the same manner as in Example 1 except that the addition amount of CLAYTONE APA is changed from 2.0 parts to 0.15 parts.

Example 4

Mother toner particle 4 and Toner 4 are prepared in the same manner as in Example 1 except that the addition amount of CLAYTONE APA is changed from 2.0 parts to 4.0 parts.

Example 5

Mother toner particle 5 and Toner 5 are prepared in the same manner as in Example 1 except that CLAYTONE APA is changed to CLAYTONE HY (manufactured by Southern Clay Product Inc.).

Example 6

Mother toner particle 6 and Toner 6 are prepared in the same manner as in Example 1 except that CLAYTONE APA is changed to CLAYTONE AF (manufactured by Southern Clay Product Inc.).

Example 7

Preparation of Coloring Agent Liquid Dispersion 1

The following recipe is dissolved and dispersed using ULTRAVISCOMILL from AIMEX to prepare Coloring agent liquid dispersion 1 in which a coloring agent (black pigment) is dispersed:

| | |
|---|---|
| Carbon black (PRINTEX 35, manufactured by Degussa Corporation) | 125 parts |
| AJISPER PB821 (manufactured by Ajinomoto Fine-Techno Co., Inc.) | 18.8 parts |
| Ethyl acetate (Special grade, manufactured by Wako Pure Chemical Industries, Ltd.) | 356.2 parts |

Preparation of Releasing Agent Liquid Dispersion 1 (Wax Component A)

The following recipe is wet-pulverized using ULTRAVISCOMILL from AIMEX to prepare Releasing agent liquid dispersion 1:

| | |
|---|---|
| Carnauba wax (melting point: 83° C., acid value: 8 mgKOH/g, saponification value: 80 mgKOH/g) | 30 parts |
| Ethyl acetate (Special grade, manufactured by Wako Pure Chemical Industries, Ltd.) | 270 parts |

Preparation of Laminar Compound (Form Irregulating Agent Liquid Dispersion A) Modified By Organic Cation The following recipe is wet-pulverized using ULTRAVISCOMILL from AIMEX to prepare a form irregulating agent liquid dispersion A:

| | |
|---|---|
| CLAYTONE APA (manufactured by Southern Clay Product Co., Ltd.) | 30 parts |
| Ethyl acetate (Special grade, manufactured by Wako Pure Chemical Industries, Ltd.) | 270 parts |

The following recipe is mixed and stirred until uniformly mixed to prepare Liquid A.

| | |
|---|---|
| Polyester (1) (Polyester resin, Mw: 50,000, Mn: 3,000, acid value: 15 mgKOH/g, hydroxyl value: 27 mgKOH/g, Tg: 55° C., softening point: 112° C., made of adduct of bisphenol A with ethylene oxide, adduct of bisphenol A of propylene oxide, and a terephtahlic acid derivative) | 350 parts |
| Coloring agent liquid dispersion | 1237 parts |
| Releasing agent liquid dispersion 1 | 72 parts |
| Releasing agent liquid dispersion 2 (Form irregulating agent liquid dispersion A) | 304 parts |
| Hydrophobic silicone particulates (R972, manufacture by NIPPON AEROSIL CO., LTD.) | 17.8 parts |

The following is stirred for 3 minutes using T.K. HOMODISPER fmodel (manufactured by Primix Corporation) to prepare Liquid B:

| | |
|---|---|
| Calcium carbide in which 40 parts of calcium carbide particulates is dispersed in 60 parts of water | 100 parts |
| 1% aqueous solution of CELLOGEN BS-H, manufactured by Dai-ichi Kogyo Seiyaku Kogyo Co., Ltd. | |
| Water | 157 parts |

Next, 345 parts of Liquid B and 250 parts of Liquid A are stirred for 2 minutes using using T.K. HOMOMIXER mark2 fmodel (manufactured by Primix Corporation) at a rotation of 10,000 rpm to obtain a suspension. The solvent is removed by stirring the suspension by a propeller type stirring device for 48 hours at room temperature and normal pressure. Hydrochloric acid is added to remove calcium carbide followed by washing, drying and classifying to obtain a toner, which has a volume average particle diameter of 6.2 μm.

Example 8

Preparation of Non-Solvent Resin

In an autoclave equipped with a stirrer, a heating device and a cooling device which is controlled to keep 215° C., a monomer mixture in which 100 part of styrene and 0.7 parts ditertiary butyl peroxide are uniformly mixed is continuously added in 30 minutes and the mixture is held for another 30 minutes at 215° C. to obtain a non-solvent resin. The obtained non-solvent resin has a molecular weight peak Mp of 4,150 and a weight average molecular weight Mw of 4,800.

Preparation of Resin Emulsification Liquid Dispersion

Twenty seven (27) parts of deionized water and 1 part of anionic emulsification agent (NEOGEN SC-A, manufactured by Dai-ichi Kogyo Seiyaku Kogyo Co., Ltd.) are placed in a vessel equipped with a stirrer and a dropping pump and the mixture is stirred and dissolved. A monomer liquid mixture containing 75 parts of styrene, 25 parts of butyl acrylate and 0.05 parts of divinylbenzene is dropped while stirring to obtain a monomer emulsification liquid dispersion.

In an anti-pressure reaction container equipped with a stirrer, a pressure gauge, a thermometer and a dropping pump, 120 parts of deionized is placed. After nitrogen replacement, the container is heated to 80° C. and 5% by weight of the monomer emulsification liquid dispersion is added to the anti-pressure reaction container followed by an addition of 1 part of 2% by weight of potassium persulfate to conduct an initial polymerization at 80° C. After heated to 85° C., the rest of the monomer emulsification liquid dispersion and 4 parts of potassium persulfate are added in 3 hours and held for another 2 hours at the same temperature to obtain a styrene based resin emulsification liquid dispersion having a particle diameter of 0.15 μm and a solid portion density of 40%. The obtained resin emulsification liquid dispersion has a high polymerization replacement ratio and is stably polymerized. After separating resin from the resin emulsification liquid dispersion by a super centrifuge device to analyze the molecular weight, the weight average molecular weight Mw thereof is 950,000 and the molecular weight peak Mp is 700,000.

One hundred (100) parts of the non-solvent resin and 135 part of the resin emulsification liquid dispersion are continuously mixed at a jacket temperature of 215° C. by a continuous mixing and kneading device (KRC KNEADER, manufactured by Kurimoto Ltd.) and heated to remove water to obtain an evaporated dehydrated kneaded mixture having a moisture not greater than 0.1%. The remaining monomer content of the obtained evaporated dehydrated kneaded mixture is 80 ppm. The evaporated dehydrated kneaded mixture is cooled down and pulverized by a hammer mill followed by fine pulverization by a jet mill to obtain a styrene acrylic resin 1.

Toner is obtained in the same manner as in Example 7 except that polyester resin 1 is changed to styrene acrylic resin 1.

Example 9

Five (5) parts of $Na_3PO_4$ is introduced to 500 parts of deionized water and the resultant is heated to 60° C. followed by stirring by a CLEARMIX high speed stirrer (manufactured by Mtechnique Co., Ltd., peripheral speed of 22 m/s). To the liquid, an aqueous solution in which 2 parts of $CaCl_2$ is dissolved in 15 parts of deionized water is quickly added to obtain an aqueous dispersing medium containing $Ca_3(PO_4)_2$.

The following recipe is heated to 60° C. and stirred to uniformly dissolve or disperse each recipe in the polymeric monomer.

| | |
|---|---|
| Polymeric monomer: Styrene | 85 parts |
| n-butylacrylate | 20 parts |
| Coloring agent: C.I. Pigment blue 15 | 37.5 parts |
| Charge controlling agent E-38 (manufactured by Orient Chemical Industries Ltd.) | 1 part |

-continued

| | |
|---|---|
| Polarity resin: Saturated polyester (Acid value: 10 mgKOH/g, Peak molecular weight: 7,500 | 5 parts |
| Releasing agent: Ester wax (Maximum endothermic peak temperature by DSC: 72° C.) | 15 parts |
| CLAYTON APA (manufactured by Southern Clay Product Inc.) | 15 parts |

As a polymerization initiator, 3 parts of 2,2'-azobis (2,4-dimethyl Valero nitrile) is added thereto to prepare a polymeric monomer component.

The polymeric monomer component is introduced in the aqueous dispersion medium and the resultant is stirred for 15 minutes by a CLEARMIX high speed stirrer (manufactured by Mtechnique Co., Ltd., peripheral speed of 22 m/s) at 60° C. in nitrogen atmosphere to obtain particles of the polymeric monomer component in the aqueous dispersion medium. After dispersion, the stirrer is stopped and the resultant is introduced into a polymerization device equipped with a full-zone stirring wing (manufactured by Kobelco Eco-Solutions Co., Ltd.). In the polymerization device, the polymeric monomer is subject to 5 hour treatment at 60° C. in nitrogen atmosphere with the stirring wing stirring at maximum stirring peripheral speed of 3 m/s. Thereafter, the temperature is raised to 80° C. and the reaction of the polymeric monomer is conducted for another 5 hours. A toner is obtained after washing, drying, and classification and the average particle diameter thereof is 5.8 μm.

Example 10

Mother toner particle 5 and Toner 5 are prepared in the same manner as in Example 1 except that CLAYTONE APA is changed to Bentone SD-2 (manufactured by Elementis Plc.).

Comparative Example 1

Preparation of Non-Modified Polyester

The following components are contained in a reaction container equipped with a condenser, stirrer and a nitrogen introducing tube to conduct a reaction at 230° C. under normal pressure for 10 hours to obtain Non-modified polyester resin 2.

| | |
|---|---|
| Adduct of bisphenol A with 2 mol of ethylene oxide | 229 parts |
| Bisphenol A with 3 mole of propylene oxide | 529 parts |
| Terephthalic acid | 208 parts |
| Isododecenyl succinic anhydrate | 80 parts |
| Dibutyl tin oxide | 2 parts |
| trimellitic anhydride | 44 parts |

The obtained non-modified polyester resin 2 has a number average molecular weight of 7,200 and a weight average molecular weight of 16,000, a glass transition temperature of 65° C. and an acid value of 15 mgKOH/g.

Preparation of Toner

The following recipe is sufficiently stirred and mixed. Kneading and mixing is conducted for 1 hour by two rolls the surface of which is heated to 100° C. Subsequent to rolling and cooling at a rate of 5°/minute and rough pulverization, pulverization classification is performed by I-2 type mill (manufactured by Nippon Pneumatic Mfg. Co., Ltd.) and DS classification device (manufactured by Nippon Pneumatic Mfg. Co., Ltd.) to obtain Mother toner particle 6 having a weight average particle diameter of 7.1 μm.

| | |
|---|---|
| Non-modified polyester resin 2 | 85 parts |
| Master batch 1 | 15 parts |
| CLAYTONE APA | 1 part |

As external additives, 1.0 part of a hydrophobic silica and 0.5 parts of hydrophobic titanium oxide are added to 100 parts of mother toner particle 1 followed by mixing HENSCHEL MIXER (manufactured by Mitsui Mining Company, Limited) to manufacture Toner 6.

Comparative Example 2

Mother toner particle 7 and Toner 7 are prepared in the same manner as in Comparative Example 1 except that the addition amount of CLAYTONE APA used as a charge controlling agent is changed from 1.0 parts to 2.0 part.

Comparative Example 3

Mother toner particle 8 and Toner 8 are prepared in the same manner as in Comparative Example 1 except that the addition amount of CLAYTONE APA is changed from 1.0 part to 4.0 parts.

Comparative Example 4

Mother toner particle 9 and Toner 9 are prepared in the same manner as in Comparative Example 1 except that CLAYTONE APA is changed to non-modified laminar inorganic montmorillonite (KUNIPIA, manufactured by Kunimine Industries Co., Ltd.).

Evaluations are made on the toners obtained as described above.

Device: 1600 type X ray photoelectron spectroscopy, manufactured by Ulvac-PHI, Inc.

Condition: X ray source: MgKa (100 W)

Analysis area: 0.8×2.0 mm

Toner is placed on a carbon sheet on the sample holder for measurement.

Kneaded mixture is prepared by melting and kneading the toners at 130° C. for 30 minutes by a Laboplastmill at a rotation of 70 rpm to obtain blocks. The blocks are coarsely pulverized and the resultant is placed on the carbon sheet.

Based on the peak intensity of each of measured atomic densities, the surface atomic density is estimated by calculation using relative sensitivity factor presented by Ulvac-PHI, Inc.

With regard to the measurement this time, Al is contained in the laminar inorganic compound so that the atomic density is measured for Al.

The measuring results are shown below.

TABLE 1

(Surface atomic density (%) of toner)

| | C (%) | N (%) | 0 (%) | Si (%) | Specific atom Al (A) (%) |
|---|---|---|---|---|---|
| Example 1 | 69.71 | 0.67 | 20.56 | 8.24 | 0.82 |
| Example 2 | 71.16 | 0.87 | 20.08 | 7.09 | 0.80 |
| Example 3 | 74.89 | 0.28 | 18.10 | 5.80 | 0.93 |

TABLE 1-continued (Surface atomic density (%) of toner)

| | C (%) | N (%) | 0 (%) | Si (%) | Specific atom Al (A) (%) |
|---|---|---|---|---|---|
| Example 4 | 68.73 | 0.69 | 20.85 | 9.15 | 0.58 |
| Example 5 | 72.96 | 0.95 | 19.06 | 6.51 | 0.52 |
| Example 6 | 70.30 | 1.58 | 20.50 | 6.99 | 0.63 |
| Example 7 | 69.71 | 0.68 | 21.70 | 7.28 | 0.63 |
| Example 8 | 68.45 | 1.10 | 21.28 | 8.66 | 0.51 |
| Example 9 | 74.26 | 0.74 | 18.30 | 6.20 | 0.50 |
| Example 10 | 70.6 | 1.0 | 20.3 | 7.2 | 0.92 |
| Comparative Example 1 | 69.01 | — | 23.50 | 7.18 | 0.31 |
| Comparative Example 2 | 65.30 | — | 24.50 | 9.79 | 0.41 |
| Comparative Example 3 | 53.50 | — | 36.70 | 9.22 | 0.58 |
| Comparative Example 4 | 70.30 | 0.87 | 20.90 | 7.50 | 0.42 |

Atomic densities (%) are measured for the mixed and kneaded compound from the toner by XPS. Table 2 shows the surface atomic density of Al before {referred to as A (%)} and after {referred to as B (%)} mixing and kneading.

TABLE 2

| | Specific atom Al A Atomic (%) | Specific atom Al B Atomic (%) |
|---|---|---|
| Example 1 | 0.82 | 0.3 |
| Example 2 | 0.80 | 0.25 |
| Example 3 | 0.93 | 0.2 |
| Example 4 | 0.58 | 0.33 |
| Example 5 | 0.52 | 0.31 |
| Example 6 | 0.51 | 0.39 |
| Example 7 | 0.63 | 0.3 |
| Example 8 | 0.51 | 0.35 |
| Example 9 | 0.50 | 0.37 |
| Example 10 | 0.92 | 0.35 |
| Comparative Example 1 | 0.31 | 0.33 |
| Comparative Example 2 | 0.41 | 0.42 |
| Comparative Example 3 | 0.58 | 0.58 |
| Comparative Example 4 | 0.42 | 0.38 |

The A and B of the pulverized toner prepared in Comparative Examples are not different.

The results of Examples 6 and 9 do not satisfy the relationship: A>B×1.4.

Charging Property

Nine (9) g of a carrier and 1 g of mother toner particle are placed in a stainless cylindrical pot having a Φ of 30 mm and a width of 30 mm followed by stirring at 600 rpm with stirring time of 60 seconds, 10 minutes and 24 hours to confirm the charging property of 3 points.

Subsequent to stirring, 1 g of the stirred developing agent is measured by a blow-off device manufactured by KYOCERA Chemical Corporation. After measuring the amount of charge, blown carriers are collected again and new mother toner particles are added thereto to confirm the amount of charge after 10 minute stirring.

The 60 second stirring is used as a criteria of initial rise of the charging. The amount of charge after 10 minute stirring is preferred to be significantly the amount of charge as a result of the 60 second stirring.

When a day stirring is compared with 60 second stirring, both charging properties are desired to be unchanged. An amount of charge that decreases after one day may cause an adverse effect on spent, leak, etc.

The reason the charging property is measured after the blowing and the charging property after 10 minutes (new toner) is to confirm that mother toner particle components are attached to and spent on the surface of carriers and the charging ability is maintained when new toner is put. When this charging deteriorates in comparison with the combination of new toner, it can be concluded that the toner is not suitable for use in an extended period.

Background Fouling

After 10,000 run at Ricoh ipsio Color 8100, white solid image is run and the machine is suspended in order that the background fouling portion on the image bearing member is transferred to measure id thereof. When id is not less than 0.03, the background is considerably fouled and when id is not less than 0.05, it is recognized background fouling in an image.

Fixing Property

Ricoh ipsio color 8100 is remodeled and adjusted such that the toner is developed in 0.9 to 1.0 mg/cm$^2$ in a solid image. The upper limit fixing temperature below which offset does not occur is measured by using type 6200 paper manufactured by Ricoh Co., Ltd. The lower limit fixing temperature is measured by using type 6000/90 W paper manufactured by Ricoh Co., Ltd. The lower limit fixing temperature is determined as the fixing roll temperature below which the remaining ratio of the image density is less than 70% after the fixed image is rubbed by a pad.

A lower limit fixing temperature that is not lower than 150° C. is determined to be practically difficult for use as B (bad). A lower limit fixing temperature that is from 140 to 150° is determined as F (fair). A lower limit fixing temperature that is lower than 140° C. is determined as G (good).

With regard to the width of fixing, a width not less than 50° C. is determined as G (good), the range between 40 and 50° C. is determined as F (fair) and a width less than 40° C. is determined as B (bad).

The evaluation results are shown in Table 3.

TABLE 3

| | Toner | | | | Mother toner particle | | | | |
|---|---|---|---|---|---|---|---|---|---|
| | Al content | Background fouling | Limit temp. for fixing | Width of fixing | Charging amount after 60 sec. | Charging amount after 10 min. | Charging amount after 1 day | Charging for new toner | Total judgment |
| Example 1 | 0.82 | 0.01 | G | G | −25.3 | −26.1 | −24.5 | −25.5 | G |
| Example 2 | 0.80 | 0.01 | G | G | −11.3 | −20.3 | −21.2 | −19.8 | G |
| Example 3 | 0.93 | 0.02 | G | G | −5.3 | −13.5 | −14.1 | −14.3 | G |
| Example 4 | 0.58 | 0.01 | F | G | −33.1 | −30.2 | −21.1 | −28.9 | G |
| Example 5 | 0.52 | 0.01 | G | G | −18.3 | −19.1 | −19.3 | −19.1 | G |
| Example 6 | 0.51 | 0.03 | G | G | −13.5 | −14.1 | −15.3 | −13.2 | G |
| Example 7 | 0.63 | 0.02 | G | F | −11.1 | −18.3 | −19.1 | −16.3 | G |
| Example 8 | 0.51 | 0.03 | F | G | −14.1 | −15.3 | −16.3 | −13.5 | G |
| Example 9 | 0.50 | 0.03 | F | G | −8.9 | −15.5 | −13.5 | −12.1 | G |
| Example 10 | 0.92 | 0.01 | G | G | −22.1 | −23.1 | −21.8 | −22.0 | G |
| Comparative Example 1 | 0.31 | 0.5 | G | G | 0.1 | −3.5 | −3.3 | −3.4 | B |
| Comparative Example 2 | 0.41 | 0.08 | F | G | −13.5 | −17.1 | −16.9 | −8.9 | B |
| Comparative Example 3 | 0.58 | 0.03 | B | B | −21.5 | −24.3 | −21.5 | −7.1 | B |
| Comparative Example 4 | 0.42 | 0.09 | G | G | −3.1 | −5.8 | −6.3 | −3.1 | B |

This document claims priority and contains subject matter related to Japanese Patent Application No. 2006-070639, filed on Mar. 15, 2006, the entire contents of which are incorporated herein by reference.

All documents mentioned herein are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United State of America is:

1. A toner, comprising:

a colorant;

at least one binder resin; and a laminar inorganic mineral in which part or all of the ions present between the layers are modified by organic ions, wherein the laminar inorganic mineral is a bentonite, wherein the toner is prepared by a method comprising dispersing or emulsifying a toner constituent mixture liquid comprising the colorant, at least one member selected from the group consisting of at least one binder resin and at least one precursor of the binder resin, and the laminar inorganic mineral, in an aqueous medium, and wherein the toner has a property such that after it is prepared, a density (A) of the laminar inorganic mineral measured by XPS for the toner surface and a density (B) of the laminar inorganic mineral measured by XPS for the toner surface after the toner has been melted and kneaded at 130° C. for 30 minutes to obtain blocks, satisfies the following relationship:

$$A > B \times 1.4,$$

and density is measured in terms of atomic %; and wherein a ratio (Dv/Dn) of a volume average particle diameter (DV) of the toner to a number average particle diameter (Dn) of the toner is from 1.00 to 1.30 and particles of the toner having a circularity not greater than 0.950 make up 20 to 80% of all the toner particles.

2. The toner according to claim 1, wherein the density A and the density B is measured for Al, and the following relationship is satisfied: A>0.5 atomic %.

3. The toner according to claim 1, wherein all of the cations present between the layers is modified by organic cations.

4. The toner according to claim 1, wherein the toner constituent mixture liquid comprises an organic solvent in which the colorant, the at least one member selected from the group consisting of the binder resin and a precursor of the binder resin, and the laminar inorganic mineral are dispersed or dissolved.

5. The toner according to claim 1, wherein the laminar inorganic mineral is present in said toner in an amount of 0.05 to 5.0% by weight.

6. The toner according to claim 1, wherein the laminar inorganic mineral is present in said toner in an amount of 0.05 to 2.0% by weight.

7. The toner according to claim 1, comprising multiple binder resins.

8. The toner according to claim 7, comprising a binder resin having a polyester skeleton.

9. The toner according to claim 8, wherein the resin having a polyester skeleton has an acid value of from 1.0 to 50.0 mgKOH/g.

10. The toner according to claim 8, wherein the resin having a polyester skeleton has a glass transition of from 35 to 65° C.

11. The toner according to claim 7, comprising a binder resin that is a polyester resin.

12. The toner according to claim 11, wherein the polyester resin is a non-modified polyester resin.

13. The toner according to claim 11, wherein a content of the polyester resin in the binder resin ranges from 50 to 100% by weight.

14. The toner according to claim 11, wherein a weight average molecular weight of a tetrahydrofuran soluble portion of the polyester resin is from 1,000 to 30,000.

15. The toner according to claim 1, wherein the precursor of the binder resin is a modified polyester resin.

16. The toner according to claim 1, wherein the amount of particles of the toner having a particle diameter not greater than 2 μm is from 1 to 20% by number.

17. The toner according to claim 1, the precursor of the binder resin has a portion reactive with a compound having an active hydrogen group and a polymer of the precursor has a weight average molecular weight of from 3,000 to 20,000.

18. The toner according to claim 1, prepared by a method comprising:

dissolving or dispersing the colorant, at least one binder resin, at least one precursor of a binder resin, a compound for conducting an elongation reaction or a crosslinking reaction with the at least one precursor, the laminar inorganic mineral, and a release agent in an organic solvent, to prepare a toner constituent mixture liquid;

dispersing or emulsifying the toner constituent mixture liquid in an aqueous medium while subjecting the precursor to a crosslinking reaction or an elongation reaction with the compound, to prepare a toner dispersion; and removing the organic solvent from the toner dispersion.

19. The toner according to claim 1, wherein the bentonite is modified by a quaternary ammonium salt.

* * * * *